US005678695A

United States Patent [19]

Ridgeway et al.

[11] Patent Number: 5,678,695

[45] Date of Patent: Oct. 21, 1997

[54] PACKAGING STRUCTURE

[75] Inventors: Devin C. Ridgeway, Chula Vista; Terry N. Wynn, El Cajon, both of Calif.; Kevin P. Greene, Naperville; Jacqueline Marshall, St. Charles, both of Ill.

[73] Assignee: Sealed Air Corporation, Saddle Brook, N.J.

[21] Appl. No.: 541,144

[22] Filed: Oct. 11, 1995

[51] Int. Cl.[6] ..... B65D 81/05; B65D 85/38

[52] U.S. Cl. ..... 206/583; 53/449; 206/305; 206/320; 206/521

[58] Field of Search ..... 206/305, 320, 206/426, 446, 461, 466, 445, 497, 521, 524.9, 583, 591, 594, 775, 776, 778, 779, 477–483; 53/449

[56] References Cited

U.S. PATENT DOCUMENTS

| | | |
|---|---|---|
| 2,031,381 | 2/1936 | McCallum . |
| 2,707,553 | 5/1955 | Yount . |
| 2,802,565 | 8/1957 | Kabbash . |
| 2,919,797 | 1/1960 | McCracken . |
| 3,089,590 | 5/1963 | Mell . |
| 3,424,306 | 1/1969 | Munck . |
| 3,437,198 | 4/1969 | Van Saun et al. . |
| 3,507,383 | 4/1970 | Rorer . |
| 3,540,579 | 11/1970 | Hellstrom . |
| 3,669,337 | 6/1972 | Struble . |
| 3,718,275 | 2/1973 | Willinger . |
| 3,891,090 | 6/1975 | Spiegel et al. . |
| 3,905,474 | 9/1975 | Haibara . |
| 3,966,046 | 6/1976 | Deutschländer . |
| 4,030,603 | 6/1977 | Angell . |
| 4,285,432 | 8/1981 | de Villers et al. . |
| 4,306,653 | 12/1981 | Fales . |
| 4,307,804 | 12/1981 | Benham . |
| 4,494,689 | 1/1985 | Ilitch . |
| 4,606,460 | 8/1986 | Luray . |
| 4,757,900 | 7/1988 | Misser et al. . |
| 4,852,743 | 8/1989 | Ridgeway . |
| 5,086,925 | 2/1992 | Coalier et al. . |
| 5,251,760 | 10/1993 | Smith et al. . |
| 5,259,507 | 11/1993 | Smith . |
| 5,323,896 | 6/1994 | Jones . |
| 5,388,701 | 2/1995 | Ridgeway . |

FOREIGN PATENT DOCUMENTS

| | | |
|---|---|---|
| 691904 | 8/1964 | Canada . |
| 49-59982 | 5/1974 | Japan . |
| 49-77087 | 7/1974 | Japan . |
| 50-88376 | 7/1975 | Japan . |
| 50-102778 | 8/1975 | Japan . |
| 50-107583 | 9/1975 | Japan . |
| 57-177969 | 11/1982 | Japan . |
| 3-100158 | 10/1991 | Japan . |

*Primary Examiner*—Jimmy G. Foster

*Attorney, Agent, or Firm*—Bell, Seltzer, Park & Gibson, P.A.

[57] ABSTRACT

A packaging structure for holding an object securely against a rigid backing. The structure includes a substantially rigid panel having a pair of generally parallel fold lines which define respective folding side portions and a center portion. A flexible film material is superimposed on one surface of the center panel portion and extends onto the folding side portions. Means, such as opposed glue strips extending along the side portions, are provided for securing the film material to the rigid panel and for cooperating with the folding side portions to tighten the film against objects between the film and the center panel portion when the side portions are folded in a direction away from the film. The panel may include a fold line extending through the center panel portion for allowing the object to be inserted and secured beneath the film. The panel may also include openings into which projection on the folding side portions may be inserted to tighten the film. An associated method is also disclosed.

34 Claims, 27 Drawing Sheets

PACKAGING STRUCTURE

FIELD OF THE INVENTION

The present invention relates to protective packaging structures, and relates more particularly to packaging structures wherein an object to be protected is held securely between a flexible film material and a rigid backing.

BACKGROUND OF THE INVENTION

Protective packaging structures are often used when an object to be packaged requires protection from physical shock, dust, dirt and other contaminants. For example, when shipping objects which may be relatively fragile, it is often desirable to package the object inside a box to protect the object from physical impacts to the box which may occur during loading, transit and unloading. In addition, when shipping objects such as computer components, it is often desirable to protect those components from dust and dirt.

Additionally, in most cases, some additional structure is used to keep an object within a box from moving uncontrollably in the box and thus incurring damage. Such additional structures include paper or plastic dunnage, structured plastic foams, and foam filled cushions, among others.

One useful form of packaging for especially fragile objects is referred to as suspension packaging, and examples are disclosed in U.S. Pat. No. 4,852,743 issued to Louis H. Ridgeway and U.S. Pat. No. 5,388,701 issued to Devin C. Ridgeway. In suspension packaging, the object is suspended between two sheets of plastic film material in a face-to-face relationship. The sheets are usually attached to frames which are sized to fit securely within a selected size box. Thus, the object is not in contact with any substantially rigid surfaces and is protected from physical shock. It is not necessary in all cases, however, for the object to be entirely suspended within the box, such as when packaging less fragile objects. In such cases, the extra space required for full suspension packaging becomes a less efficient use of materials.

A different type of packaging system is disclosed in U.S. Pat. No. 5,323,896 to Jones. The packaging system includes a sheet material of corrugated cardboard having a central fold line extending longitudinally along the sheet material, and two fold lines extending transversely thereto. A sleeve or tube made of a flexible and stretchable material is disposed around the sheet material and is of sufficient dimensions to fit in a flat condition loosely over the width of the sheet material. The sheet material is first folded along the central fold line, as shown in FIGS. 3 and 4, and the object to be packaged is inserted between the sheet material and the flexible tube. The end portions are then folded upwardly along the transverse fold lines into a generally perpendicular position to cause the sheet material to flatten out and hold the object against the sheet material. The assembly may then be placed in a box as shown in FIG. 6. To ensure that the object is securely held, the tube must be properly dimensioned to fit the particular object being packaged. Thus, objects that vary somewhat in size from the size for which the package is designed (i.e., slightly smaller objects), would not be held securely in the package.

Another type of packaging structure is illustrated in U.S. Pat. No. 4,307,804 to Benham and has a paperboard main panel with a cut-out and first and second side support panels defined by parallel hinge lines. A heat shrinkable film is bonded to the support panel so that the article to be packaged may be inserted in the manner shown in FIG. 3. The package must then be heated so that the heat shrinkable film draws the support panels together to secure the object being packaged.

OBJECT AND SUMMARY OF THE INVENTION

Therefore, it is an object of the present invention to provide a package that will successfully hold objects of various sizes against a substantially rigid backing with sufficient tension to cushion the objects and prevent uncontrolled movement of the objects so that they are protected from physical harm.

This invention meets this object with a substantially rigid panel having a pair of generally parallel fold lines adjacent to the opposite side edges of the panel. The fold lines thus define respective folding side portions and a center portion therebetween. A flexible film material is superimposed on one surface of the rigid panel and extends over the center panel portion and past the fold lines onto the folding side portion of the rigid panel.

A means for securing the film to the folding side portions of the rigid panel, such as a glue strip extending along each of the folding side portions, is also included. The means for securing defines at least one unsecured edge portion of the film through which an object to be packaged can be inserted between the film and the center panel portion. The means also cooperates with the folding side portions to tighten the film against objects between the film and the center panel portion when the folding side portions are folded away from the film. Various specific embodiments with other folds, cuts, etc. are described below.

Another embodiment of the packaging structure of the present invention includes a substantially rigid panel against which the object is to be packaged and a flexible film material superimposed on and extending over a center portion of the panel. Adhesion means, such as a pair of glue strips, secure the flexible film material to corresponding edge portions of the center panel. The embodiment also includes a fold line extending through the center portion to allow the object to be more easily inserted and a means, such as opposed folding end portions, for returning the center portion to an unfolded orientation to secure the object between the film and the center portion.

In yet another embodiment, the folding side portions include proximal and distal folding segments which may be folded together. One or more projections may be formed on the distal folding segments and may be received in openings formed in the panel beneath the flexible film material. When inserted in the openings, the projections tighten the film against the object. An associated method of packaging an object in the packaging structure discussed herein also forms a part of the present invention. The method may include the additional step of placing the folded packaging structure into a protective box.

The foregoing and other objects, advantages and features of the invention, and the manner in which the same are accomplished, will become more readily apparent upon consideration of the following detailed description of the invention taken in conjunction with the accompanying drawings, which illustrate preferred exemplary embodiments, and wherein:

DETAILED DESCRIPTION

Figure 2:
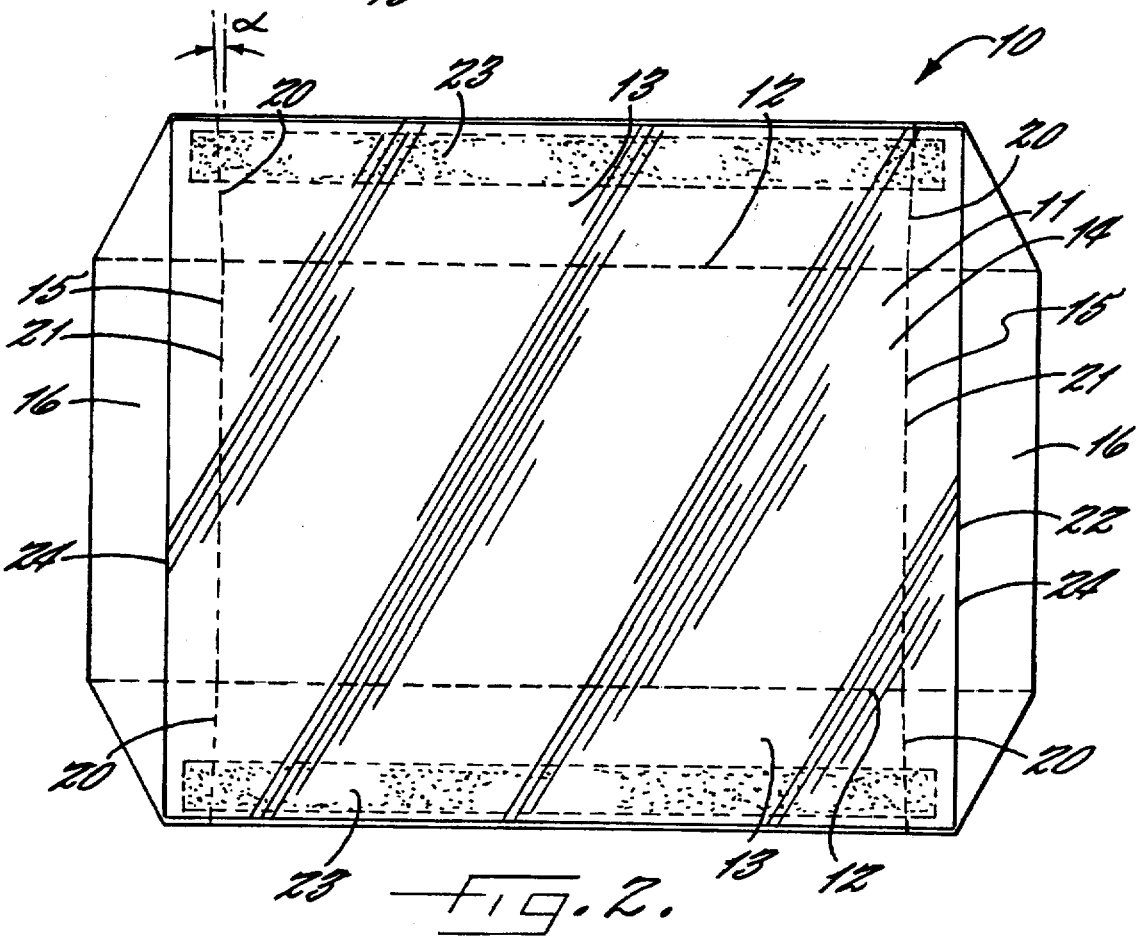
FIG. 2 is a plan view of the packaging structure in an unfolded state.

The packaging structure 10 according to the present invention includes a substantially rigid panel 11, as shown in planar form in FIG. 2. The panel 11, which will be generally rectangular or square depending on the application, may be formed of any substantially stiff but foldable material such as paperboard, cardboard or plastic. It will be appreciated that, although denominated as rigid, the chosen material would preferably have a certain amount of flexibility in the cases of extreme physical impact and that the use of very rigid materials, such as metals, may not be desirable. One preferred material is a single wall corrugated cardboard such as B-flute or E-flute corrugated cardboard.

The substantially rigid panel 11 may also include a pair of fold lines 12, usually scored, crimped or perforated, which are generally parallel and adjacent to the opposite side edges of the panel. These fold lines 12 thus define folding side portions 13 and a center portion 14 therebetween.

The packaging structure 10 may also include a second pair of fold lines 15, substantially parallel to one another and substantially perpendicular to the first pair of fold lines 12, that define respective folding end portions 16 in the rigid panel 11. The distal portions 20 of each of the second pair of fold lines 15 which extend onto the folding side portions 13 may be slightly offset by an acute angle relative to the portion 21 of the fold line extending over the center panel portion. The purpose of this offset, which is denoted by the angle $\alpha$ in FIG. 2, is to account for the finite thickness of the rigid material of the panel 11 when the side 13 and end 16 portions are folded, as will be understood from the discussion below.

A flexible film material 22 is superimposed on one surface of the rigid panel 11, and extends over the center panel portion 14. This flexible film material 22 is preferably a transparent and elastomeric polymer and in preferred embodiments may be formed of PVC (polyvinyl chloride) or polyurethane esther. By way of comparison, PVC film is generally less expensive and more transparent and may be more preferable for lightweight applications wherein a thickness of only 2–4 mils is necessary. Films made of polyurethane esther are generally more elastomeric, puncture resistant, and better suited for larger objects. Polyurethane esther is also generally less sensitive to temperature changes and more tacky which is useful for restraining the object from slippage. The polyurethane esther films may be manufactured with a slip agent, however, to control excessive tackiness. One particular preferred resin used in the manufacture of the film is SP876, a commercially available product of the BASF Company. It will be understood, of course, that a number of polymeric materials are suitable for the film material 22, and can be selected, and even custom designed, by those familiar with such materials without undue experimentation.

The packaging structure 10 also includes means for securing the film 22 to the folding side portions 13 of the rigid panel 11. In a preferred embodiment, the means constitutes a pair of glue strips 23 extending along the distal edge of the folding side portions 13 as shown in FIG. 2. Of course, it would be readily apparent to one of ordinary skill in the art that there are many other equivalent means which may be used to perform the functions of the glue strips 23. The glue strips 23 thus define two unsecured edge portions 24 of the film 22 generally adjacent to the folding end portions 16 of the panel 11 through which an object O to be packaged can be inserted between the film and the center panel portion 14.

The glue strips 23 also cooperate with the folding side portions 13 to tighten the film 22 against an object O between the film and the center panel portion 14 when the folding side portions are folded downwardly (i.e. away from the film) as discussed more fully below.

Figure 1:
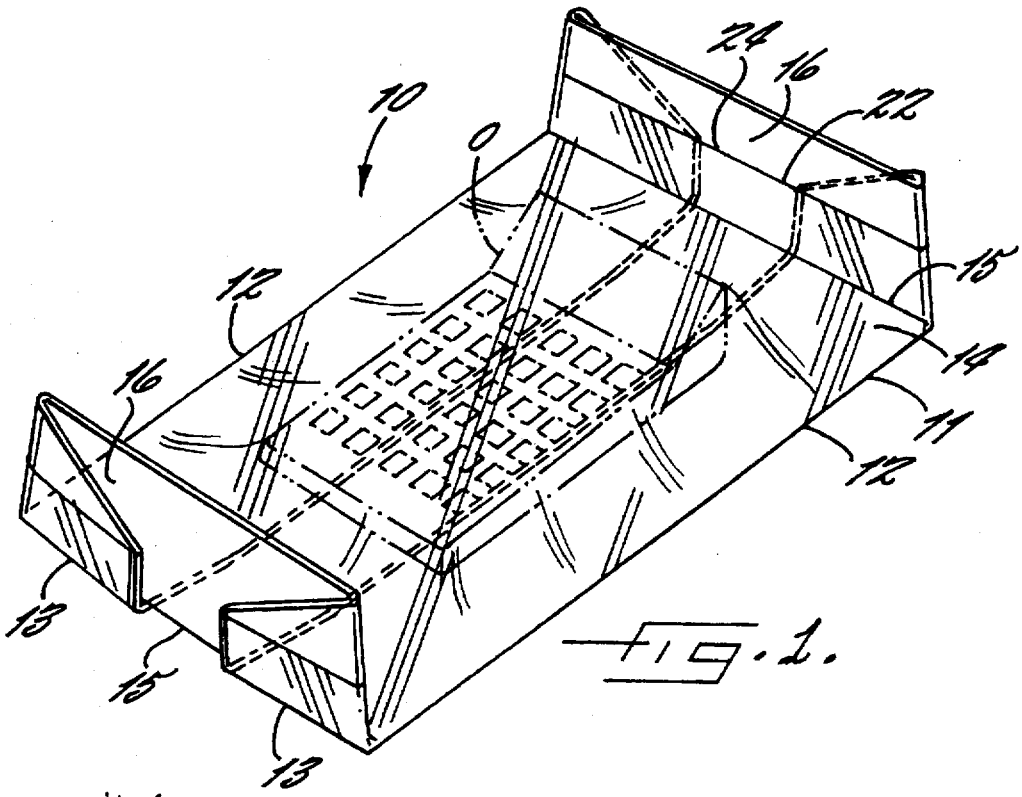
FIG. 1 is a perspective view of the packaging structure according to the present invention illustrating the position of an object packaged therein.
Figures 3, 4, 5:
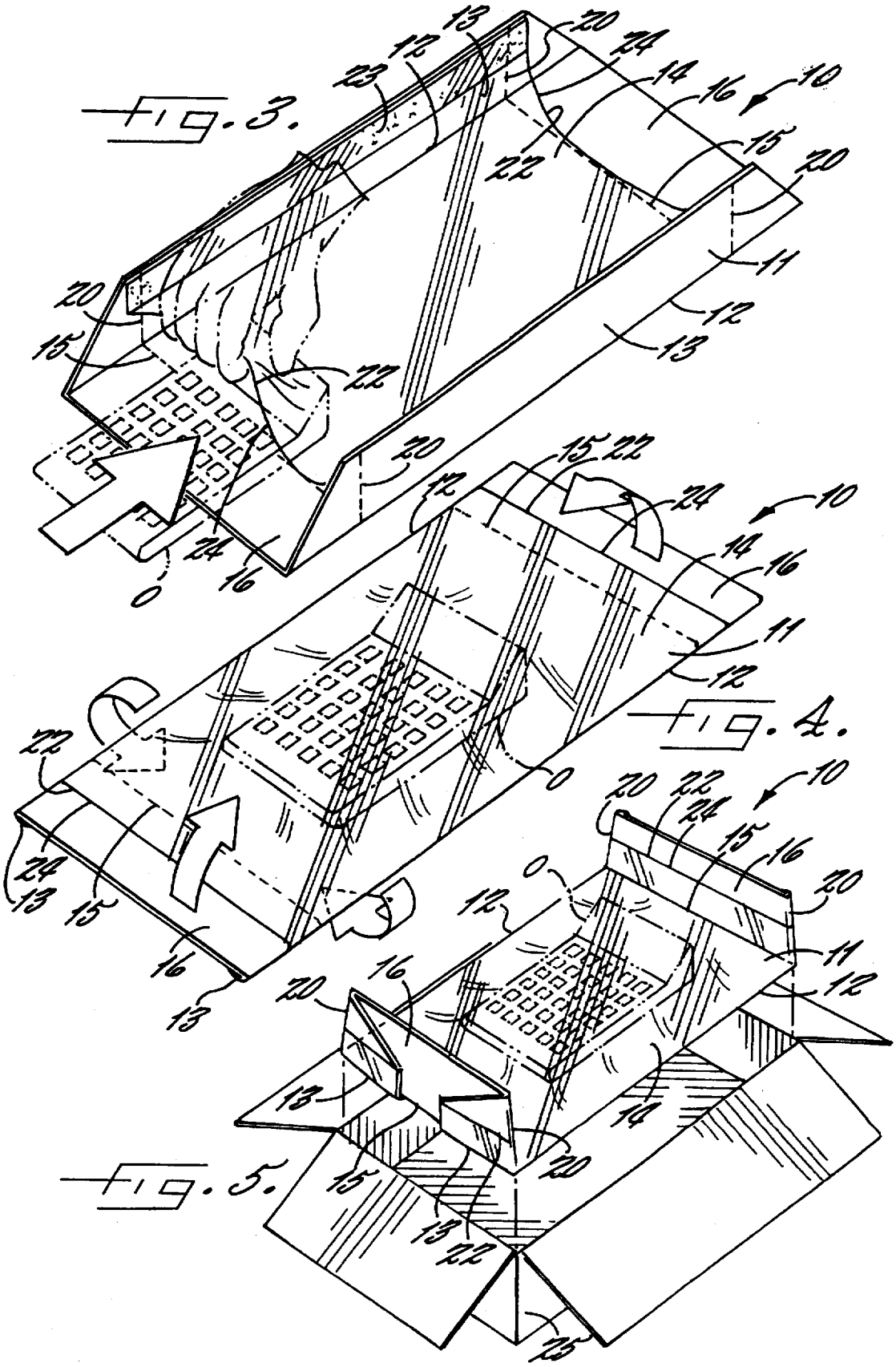
FIG. 3 is a perspective view of the packaging structure with the folding side portions folded up to illustrate the insertion of the object.
FIG. 4 is a perspective view of the packaging structure showing the direction in which the folding side portions and folding end portions are folded.
FIG. 5 is an exploded perspective view illustrating the way in which the packaging structure fits inside a box.

FIGS. 3–5 illustrate the manner of folding the embodiment of FIGS. 1 and 2 to package an object O. The folding side portions 13 are first folded upwardly (towards the film 22) to loosen the film 22 relative to the center panel portion 14 (FIG. 3). The object O to be packaged can thus be inserted more easily through one of the unsecured edge portions 24. The folding side portions 13 are then folded downwardly (away from the film material 22) through approximately 270 degrees so that the folding side portions 13 are flat against the underside of the center panel portion 14.

When the side portions 13 are folded into their packaged position (e.g. FIG. 1) they pull against those portions of the film 22 that extend past the fold lines 12. Stated differently, because the film material 22 is wrapped around the outside of the fold lines 12, it must extend over a slightly greater distance than it would when in the position shown in FIG. 2, i.e., when the side portions 13 are coplanar with the center portion 14. This increased distance tends to encourage the film 22 to stretch slightly toward the side portions 13. It will be appreciated that the strain on the film material 22 in turn increases the film's tension and grip on the object O to be packaged. This feature thus provides improved retention of the packaged object O against the panel 11.

The folding end portions 16 are then folded upwardly, or towards the flexible film 22, to the position shown in FIGS. 1 and 5. The folded panel 11 may then be inserted into a box 25 having inner dimensions which correspond in height, width and length to the folded structure 11. Thus, the object O is securely packaged against the rigid panel 11 which is in turn securely packaged within the box 25.

The present invention includes multiple embodiments, the remainder of which are discussed individually below. Where possible, element numbers for corresponding elements are the same as those used above. It will be understood that many of the features of the embodiments discussed below may be used in combination with the features of the other various embodiments.

Figure 6:
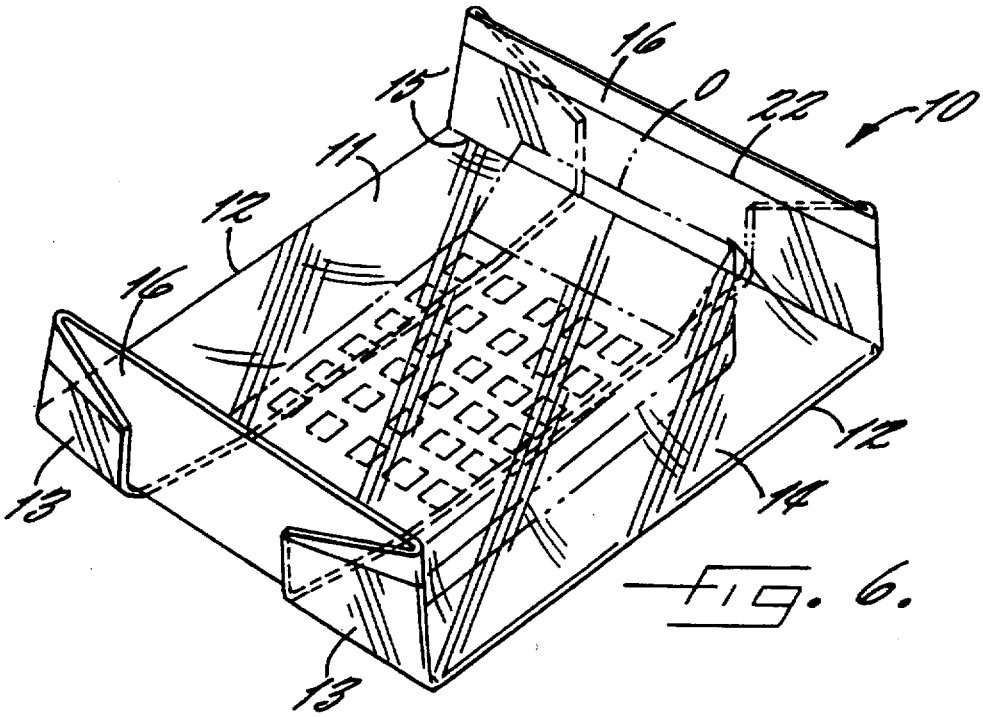
FIG. 6 is a perspective view of a second embodiment of the present invention.
Figure 7:
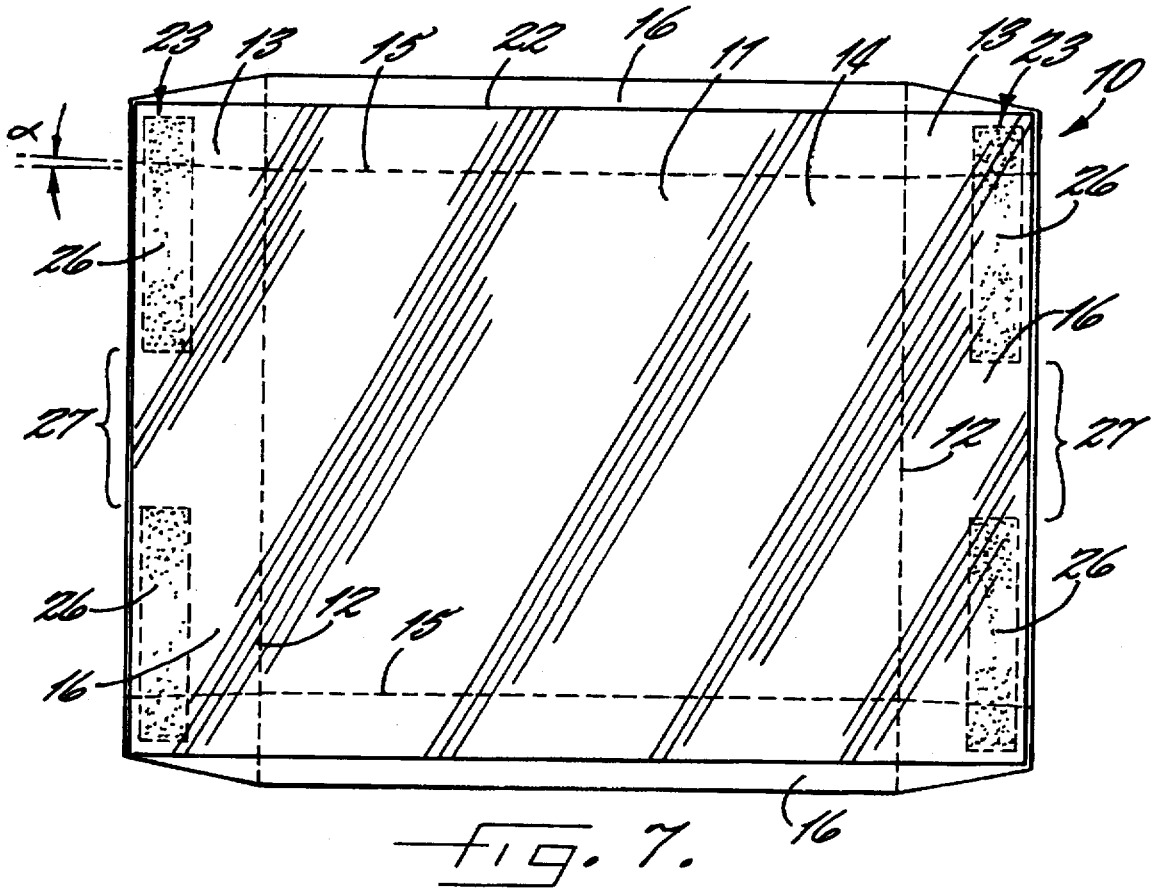
FIG. 7 is a top plan view of the second embodiment in an unfolded state illustrating a modified glue pattern.
Figure 8:
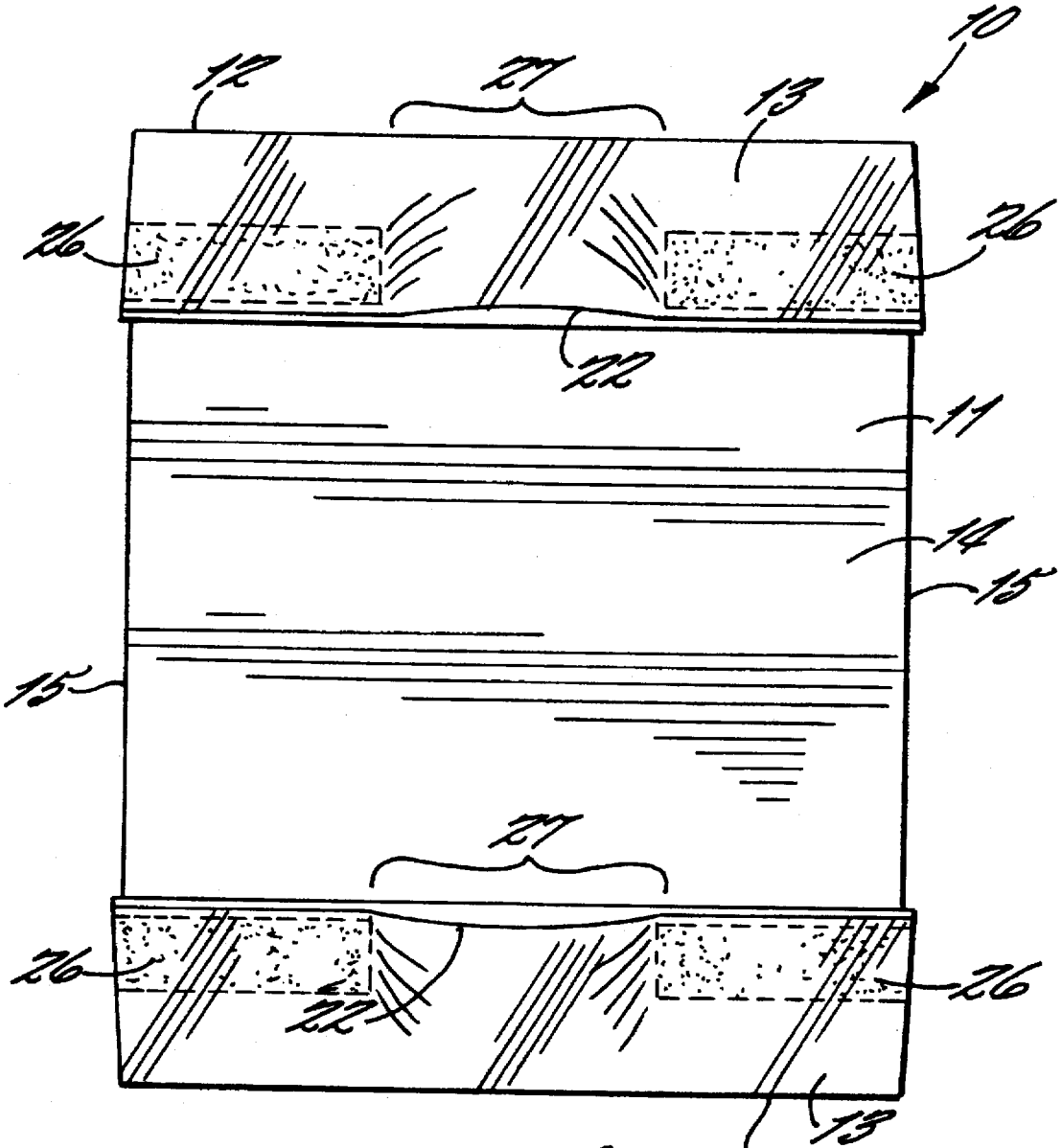
FIG. 8 is a bottom plan view of the second embodiment in a folded state.

A second preferred embodiment is illustrated in FIGS. 6–8 and is particularly useful for packaging taller objects; i.e. objects that (when packaged) extend further upwardly away from the panel 11. FIG. 7 shows that in this embodiment, each of the glue strips 23 includes two separate glue strip segments 26 having unsecured portions 27 of the film 22 therebetween. FIG. 8 illustrates that when the packaging structure 10 is folded as discussed above, the unsecured portions 27 of film between the glue strip segments 26 give slightly, which reduces the tension against a taller object O as compared to the first embodiment discussed above. The length of the unsecured portions 27 may be advantageously adjusted depending upon the height and width of the object O being packaged to provide controlled film support.

A point of terminology is worth noting here. As shown in FIG. 7, this, or other, embodiments may have folding end portions 16 which are longer (or shorter) than the folding side portions 13. As would be readily appreciated, the folding side portions 13 cooperate with the means for securing the film 22 so as to increase the tension of the film when folded, and their length relative to the folding end portions 16 is not critical to the operation of the invention. The relative lengths of the folding side portions 13 and folding end portions 16 are instead determined upon the shape and dimensions of the object being packaged. Indeed, the ease and simplicity with which the invention can be used to form custom packages is one of its significant advantages.

Figure 9:
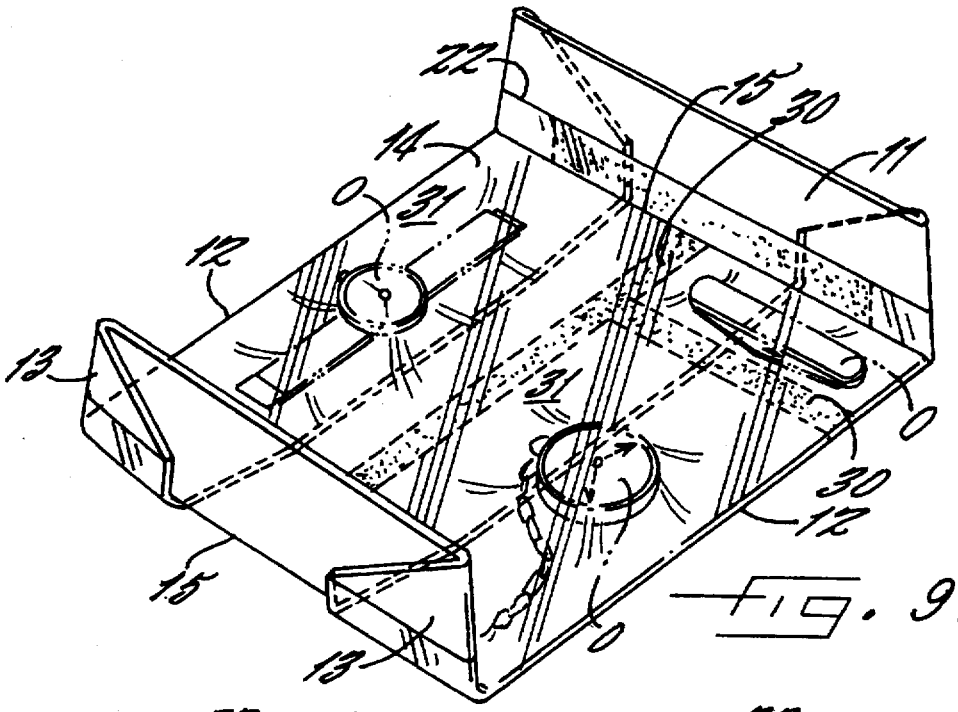
FIG. 9 is a perspective view of a third embodiment of the present invention showing the multiple objects which may be packaged therein.
Figure 10:
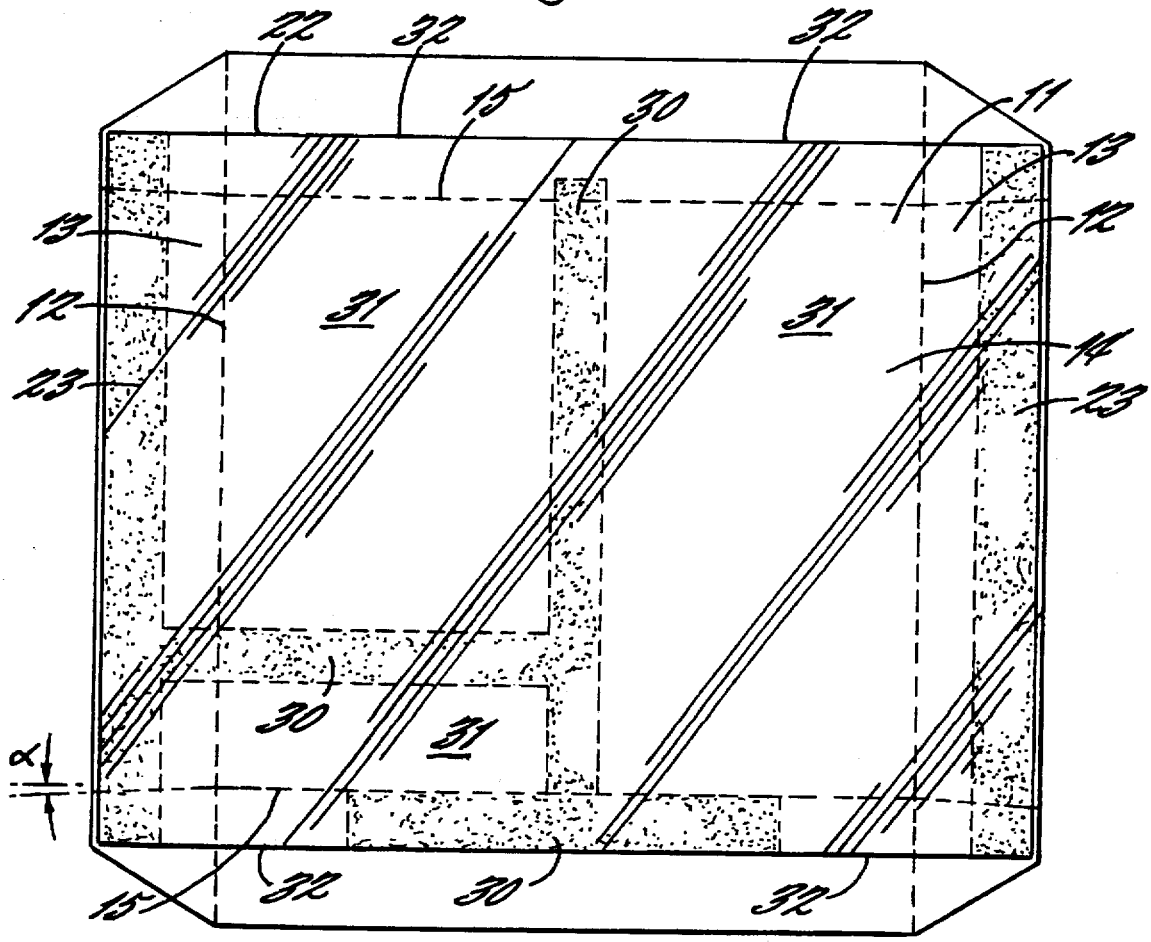
FIG. 10 is a top plan view of the third embodiment in an unfolded state.

A third embodiment is illustrated in FIGS. 9 and 10. In this embodiment, the invention includes additional glue strips 30 for securing the film 22 to the center panel portion 14. These glue strips 30 are arranged in a manner that defines several pockets 31, each of which has at least one unsecured edge portion 32. Accordingly, each of these separate pockets 31 may hold different objects O that are to be packaged together. The manner in which the panel 11 is folded and in which the film material 22 tightens to hold packaged objects is otherwise identical to the first embodiment, but with the glue strips 30 forming the additional pockets.

Figure 11:
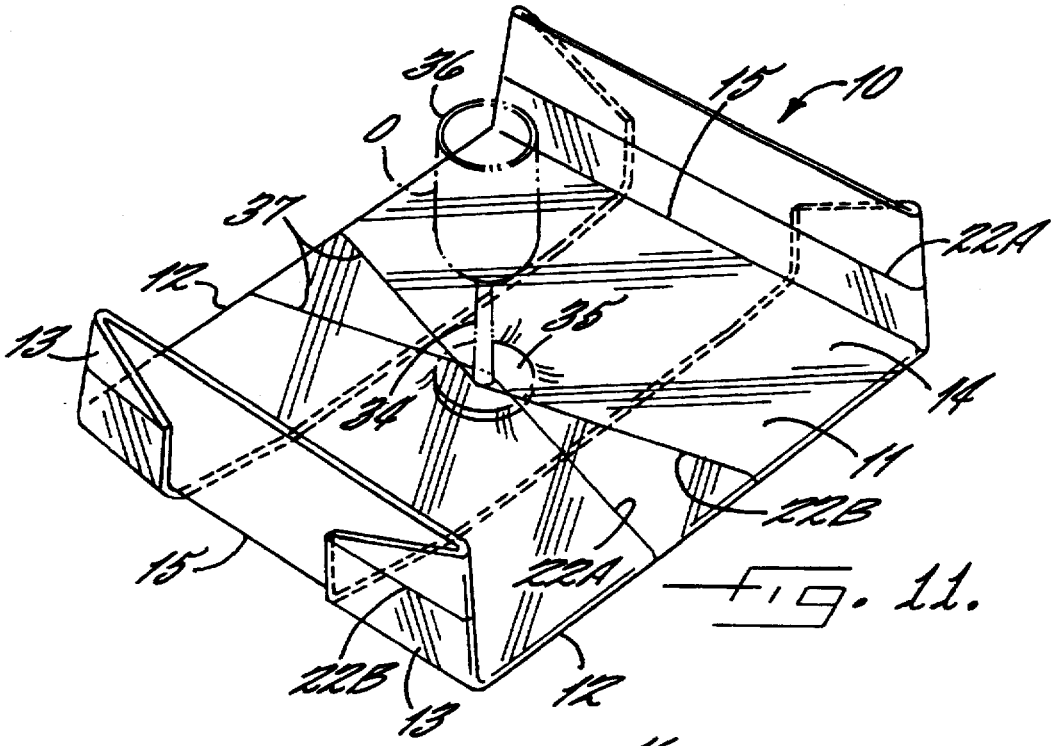
FIG. 11 is a perspective view of a fourth embodiment for packaging objects having a thinner portion.
Figure 12:
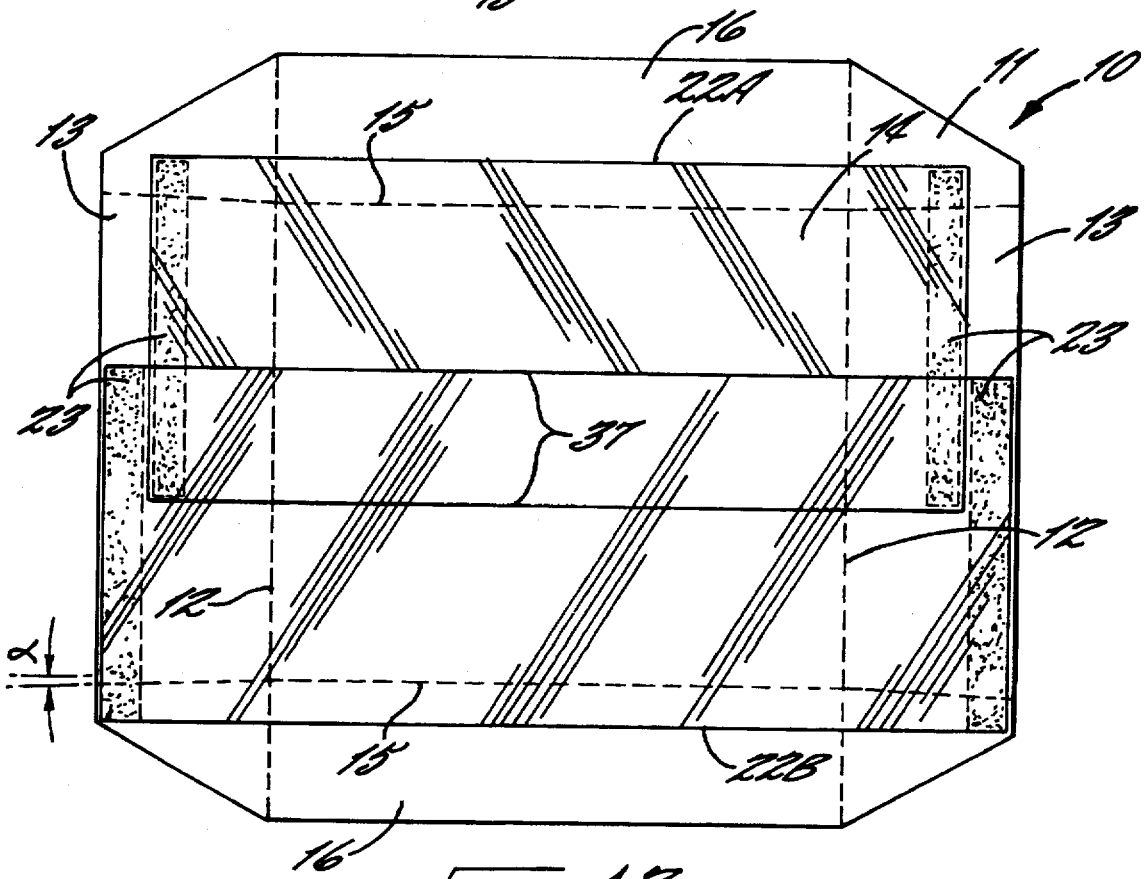
FIG. 12 is a top plan view of the fourth embodiment.

A fourth embodiment of the packaging structure 10 of the present invention is illustrated in FIGS. 11 and 12. In this embodiment, two pieces of flexible film material 22A, 22B are secured to the folding side portions 13 in a laterally adjacent manner. This embodiment is particularly useful for packaging objects O having a thinner portion 34 and a thicker portion 35 adjacent to the center panel portion 14. For example, with the wine glass 36 illustrated in FIG. 11, it is only necessary for the film portions to overlie the base 35 of the glass and the stem 34 and container portions of the glass extend thereabove. As shown in FIG. 12, the two film pieces 22A, 22B may partially overlap, or the adjacent edges 37 of the film pieces may abut or be slightly separated. Again, the manner in which the panel 11 folds and the film 22 secures an object is fundamentally the same as in the other embodiments.

Figure 13:
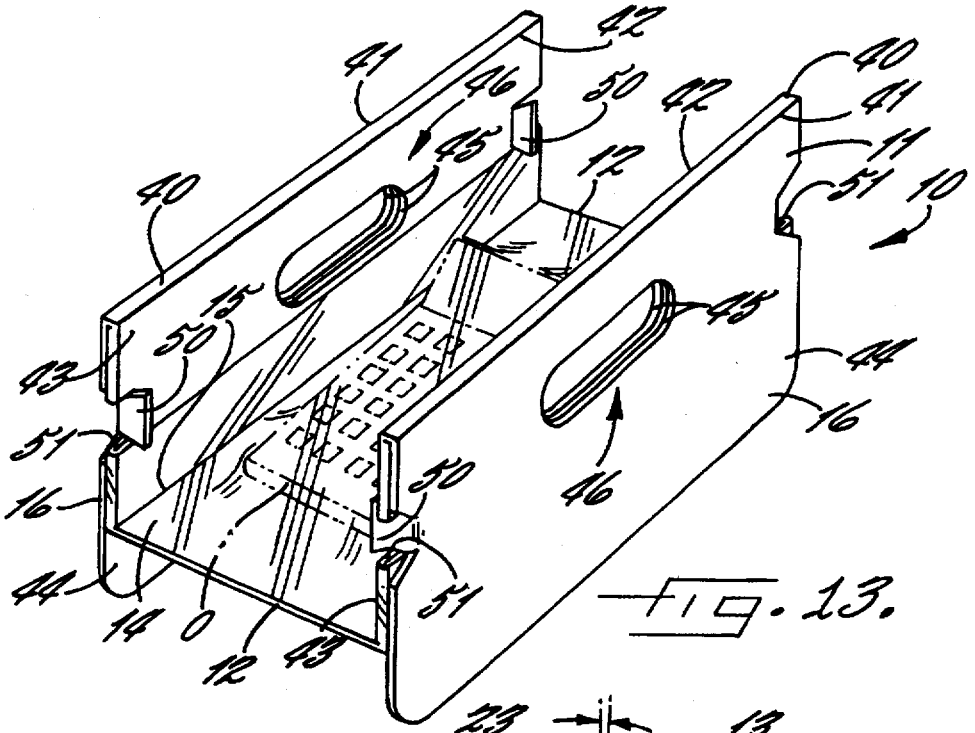
FIG. 13 is a perspective view of a fifth embodiment illustrating the handles and locking tabs.
Figure 14:
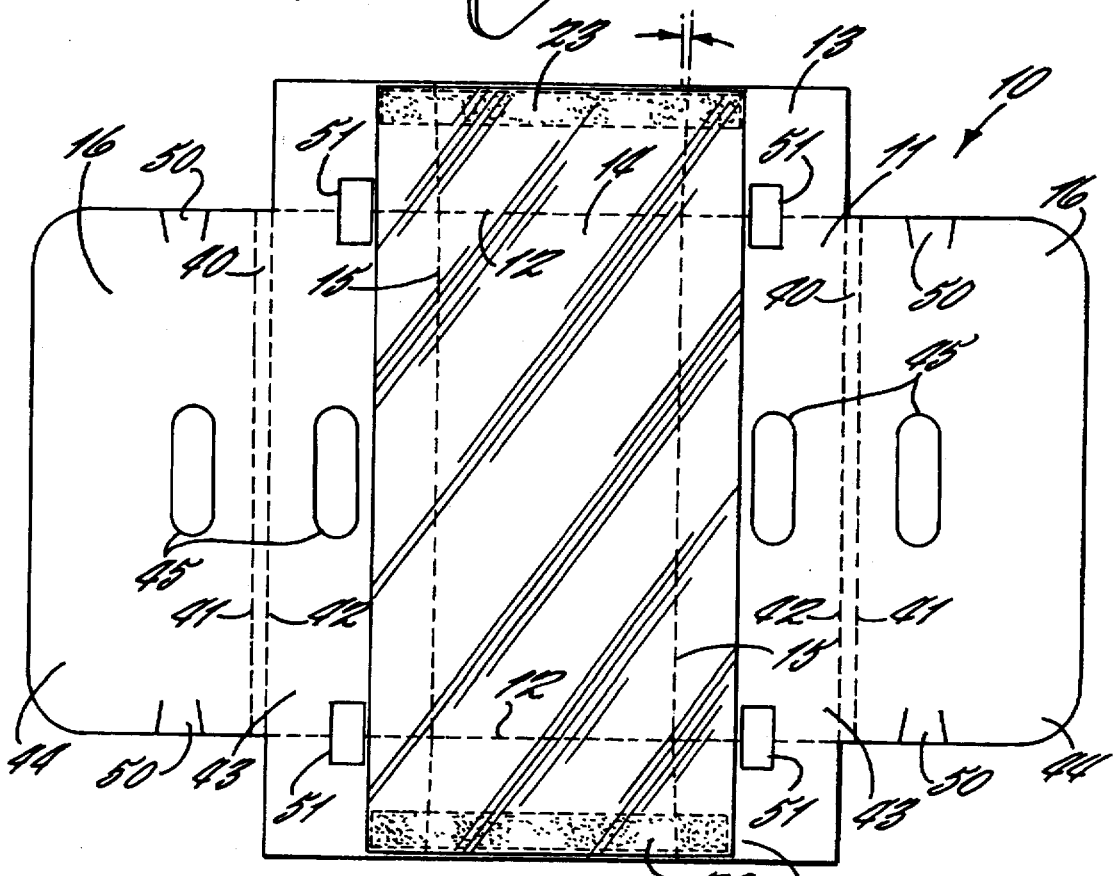
FIG. 14 is a top plan view of the fifth embodiment.

A fifth embodiment is illustrated in FIGS. 13 and 14. In this embodiment, a third pair of generally parallel fold lines 40 is formed in the folding end portions 16 generally parallel to the second pair of fold lines 15. Although denominated in the singular, it will be understood that each fold line 40 may actually include two sub-lines 41,42 separated by the distance of at least two thicknesses of the paperboard material so as to prevent crimping of the paperboard when folded. The third fold lines 40 thus define proximal 43 and distal 44 folding segments in each of the folding end portions 16.

Each of the folding end portions 16 may also include a pair of handle holes 45 formed equidistant from the respective one of the third pair of parallel fold lines 40. Thus, when the folding end portions 16 are folded in a manner as shown in FIG. 13, i.e., with the proximal segments 43 folded upwardly and the distal segments 44 folded downwardly, a pair of handles 46 is formed to allow the folded structure 10 to be more easily handled and inserted or removed from a box. The folding end portions 16 may also include a plurality of tabs 50 and notches 51 arranged such that the folded structure 10 may be locked into place by bending the tabs into the respective notches.

It will be understood, of course, that the presence of cutouts for handles or tabs for securing folds are not limited to this particular embodiment, but can be used in several or all of the embodiments as may be desired. In addition, another advantageous feature of the invention is illustrated in this embodiment by the distal segments 44 which space the center panel portion 14 from the bottom of the box 25. Thus, the object O, when placed in a box 25, is maintained out of direct contact with the box in all three axes and is protected from physical shock from any direction. In addition, having the center panel portion 14 spaced from the bottom of the box 25 will provide room for the panel portion 14 to flex slightly, thereby providing a shock absorbing function. Although described here in connection with the fifth embodiment of the invention, it will be understood that this feature may also be present in the other embodiments discussed above and below.

Figure 15:
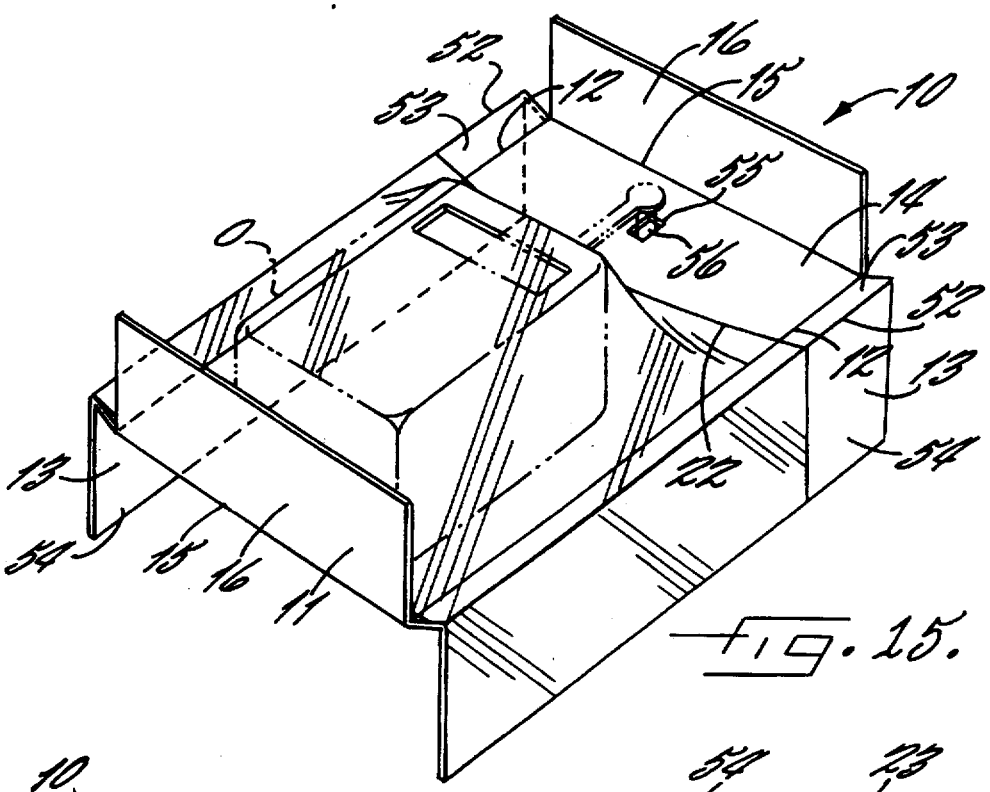
FIG. 15 is a perspective view of a sixth embodiment of the present invention for packaging larger objects.
Figure 16:
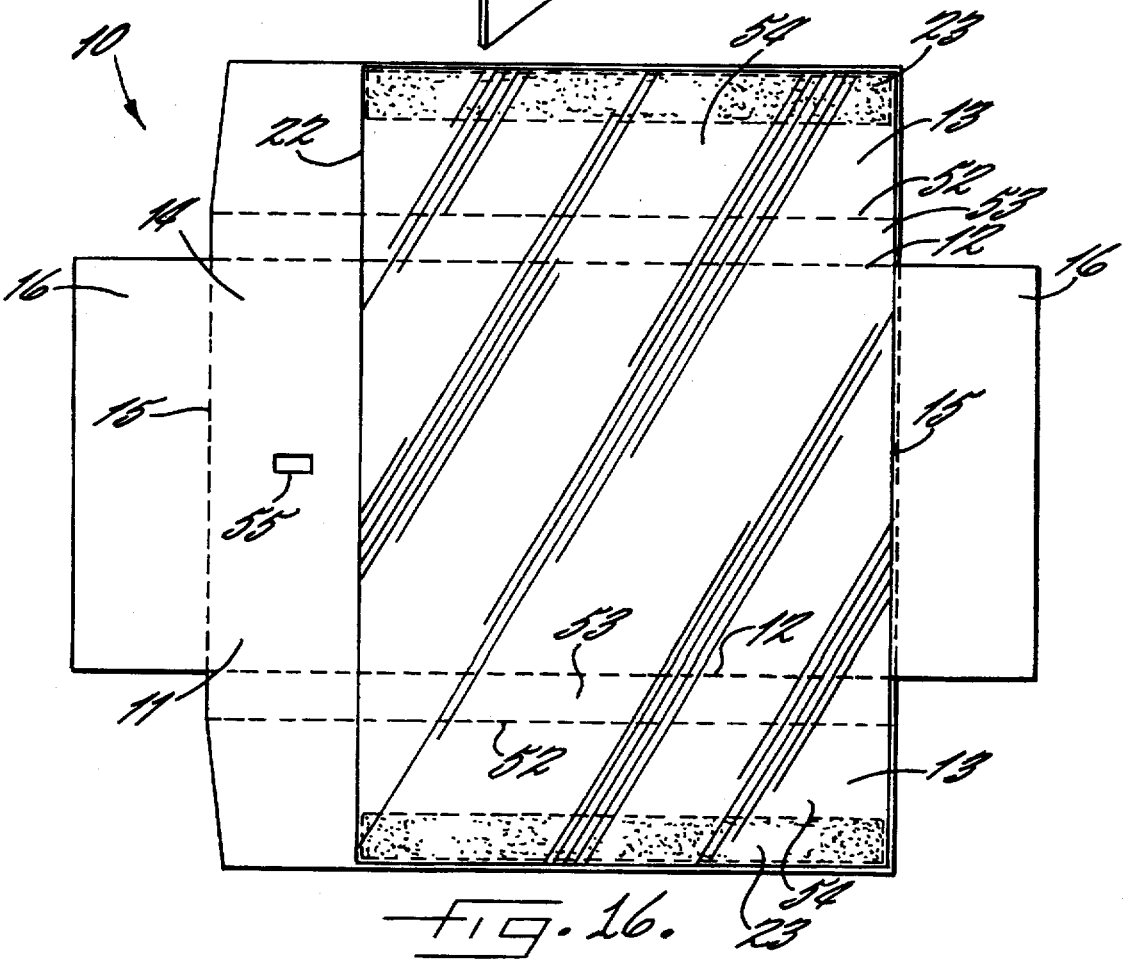
FIG. 16 is a top plan view of the sixth embodiment.

A sixth embodiment of the packaging structure 10 is illustrated in FIGS. 15 and 16 and includes a third pair of fold lines 52 in the folding side portions 13 and parallel to the first pair of fold lines 12. The third pair of fold lines 52 thus define proximal 53 and distal 54 segments in the folding side portions 13. This embodiment is advantageous for use with larger objects O because the proximal segments 53 can fold partially in the direction towards the object, thus creating more volume, and more containment area, between the film material 22 and the center panel portion 14.

The distal segments 54 are folded downwardly, as with the other embodiments, to tighten the film 22 against the object O. The distal segments 54 are not folded as far as the other embodiments, however, and are instead folded over only to a position approximately perpendicular to the center panel portion 14. Thus, when placed in box, the distal segments 54 are restrained from unfolding by the inner sides of the box. In addition, the distal segments 54 space the center panel portion 14 from the bottom of the box, which can further reduce the risk of physical impact damage.

An opening 55 may also be formed in the center panel portion 14 to accommodate a protuberance 56 of the object O being packaged.

Figure 17:
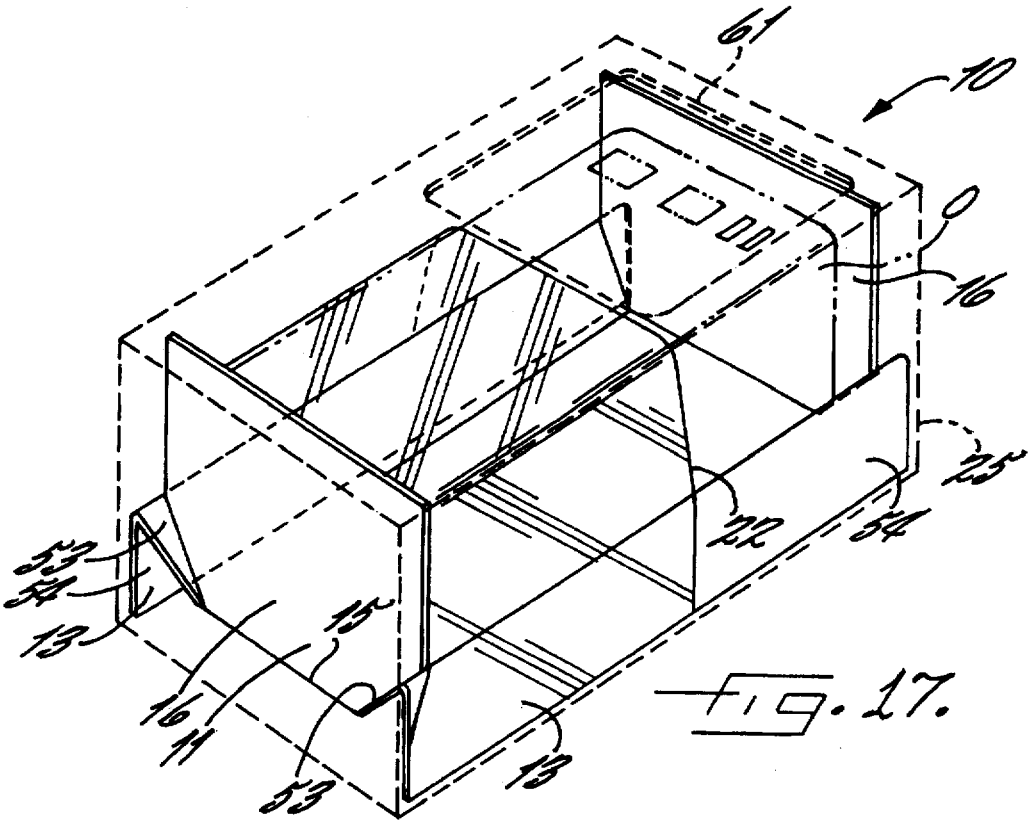
FIG. 17 is a perspective view of a seventh embodiment of the present invention.
Figure 18:
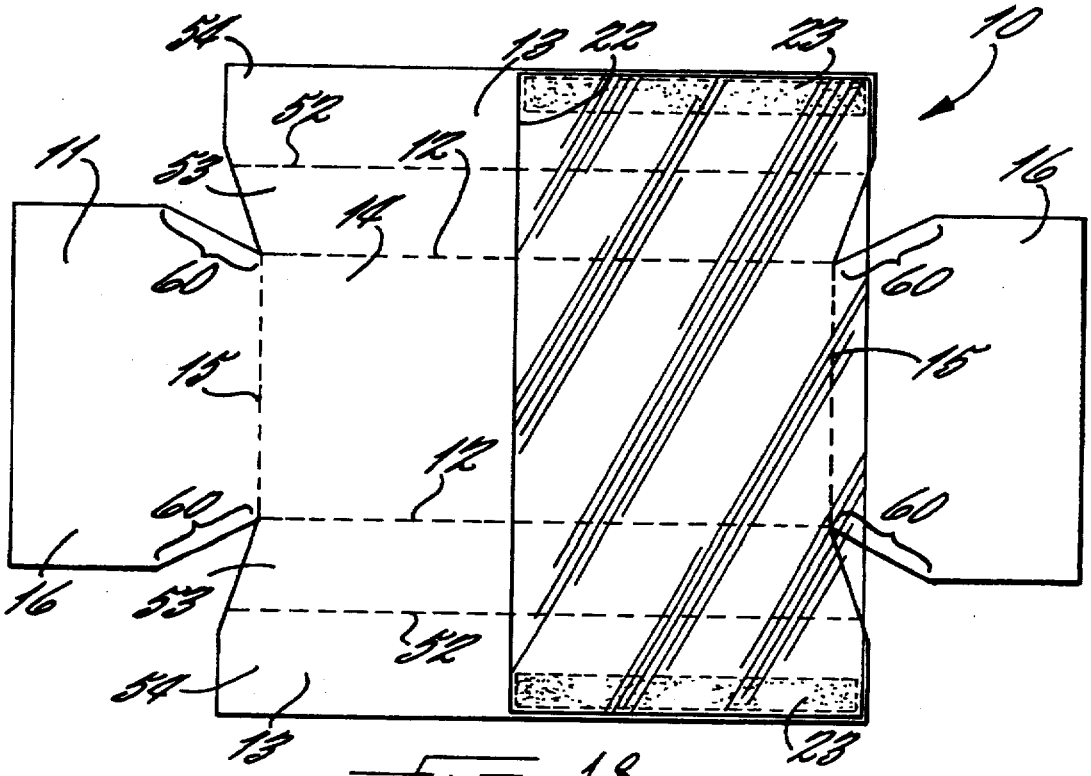
FIG. 18 is a top plan view of the seventh embodiment in an unfolded state.

A seventh embodiment is illustrated in FIGS. 17 and 18. The packaging structure 10 of this embodiment is essentially the same as the sixth embodiment in that the folding side portions 13 include proximal 53 and distal 54 segments. The seventh embodiment also includes, however, folding side 13 and end 16 portions which are flared outwardly, as best seen in the plan view of FIG. 18. Thus, when the folding end portions 16 are folded in the manner discussed above in connection with the sixth embodiment, the flared portions 60 of the folding end portions are placed in an abutting relationship with the proximal segments 53 of the folding side portions 13, as illustrated in FIG. 17. This provides added rigidity and strength to the structure 10.

Another illustrated feature of the seventh embodiment, which could also be incorporated with the other embodiments, is a shortened piece of flexible film material 22. It is not necessary for the film material 22 to extend over the entire length of the center panel portion 14 because, as would be readily appreciated, it is only necessary for a part of the object to be held between the film material and the center panel portion. It may be desirable to use a shortened piece of film 22 when, for example, it is desired that part of the object O be totally exposed, such as for aesthetic reasons.

In addition, the box 25 into which the structure 10 is inserted may include an opening 61 formed therein to expose the object O. In the case of consumer products, the shortened film and open box allow a prospective purchaser to see and touch the product without restriction.

Figure 19:
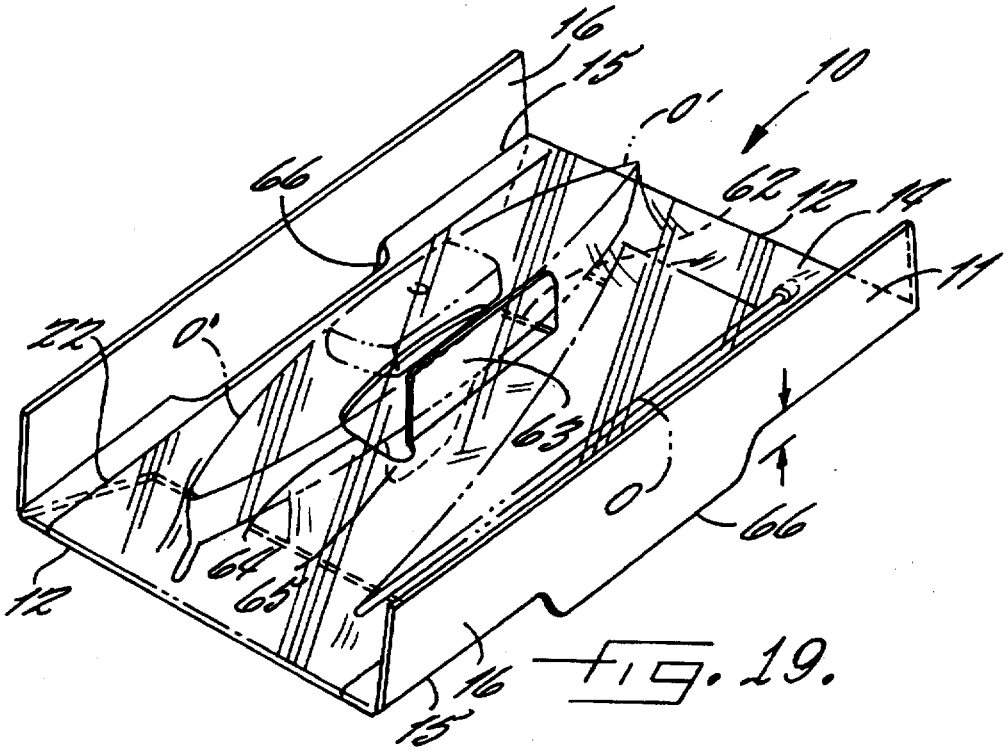
FIG. 19 is a perspective view of an eighth embodiment of the packaging structure illustrating the spacer tabs.
Figure 20:
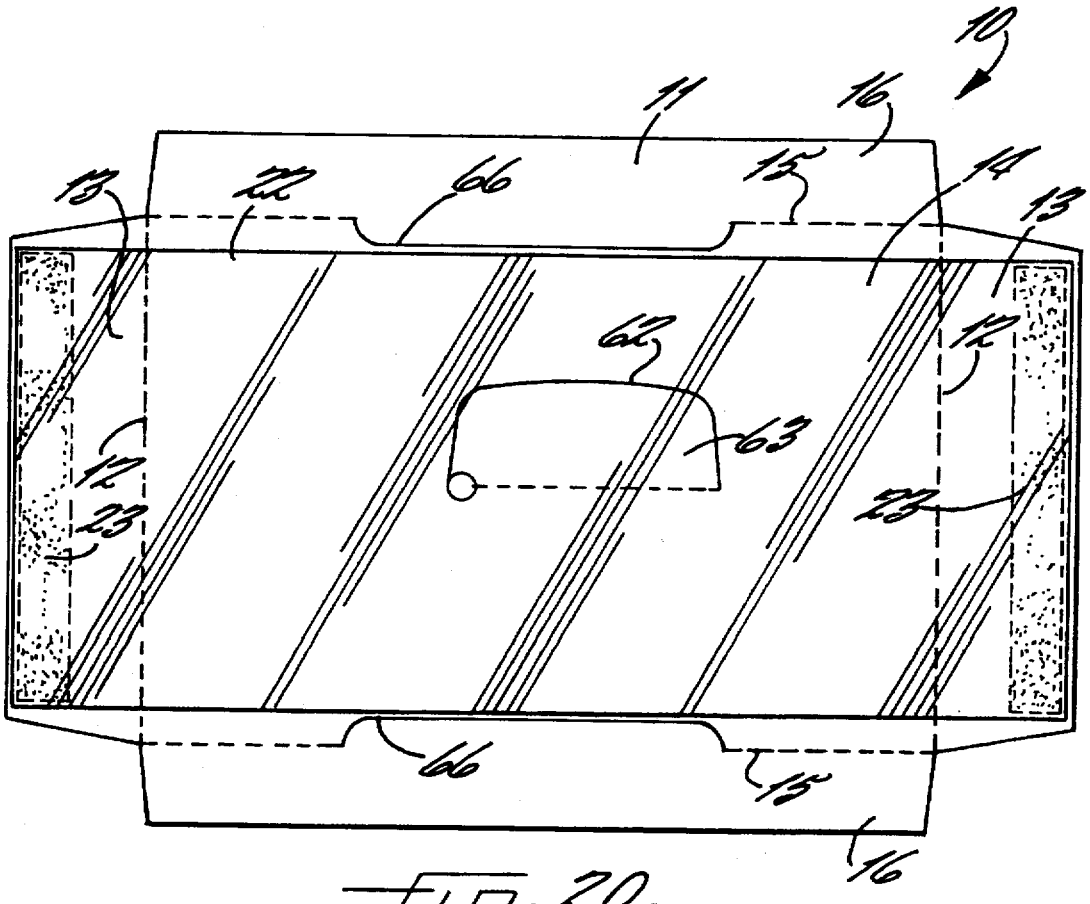
FIG. 20 is a top plan view of the eighth embodiment in an unfolded state.

An eighth embodiment of the packaging structure 10 is illustrated in FIGS. 19 and 20. The center panel portion 14 includes a patterned cut 62 that defines a folding tab 63. The tab 63 can be folded upwardly to separate two objects O, O' packaged on the center panel portion 14. The tab 63 also forms an opening 64 in the center panel portion 14 and permits a portion 65 of one object O' to project through the opening opposite from the film 22. For example, with regard to the model sailboat shown in FIG. 19, the keel 65 may extend through the opening 64 while the remainder of the hull is supported by the center panel portion 14.

A pair of spacer tabs 66 may also be cut into the center panel portion 14 from each of the second pair of fold lines 15. When the folding end portions 16 are folded upwardly, as shown in FIG. 19, the tabs 66 extend downwardly and space the bottom of the center panel portion 14 from the bottom of the box 25 so that the portion 65 of the object O' extending through the opening 64 is protected from physical impact.

Figure 21:
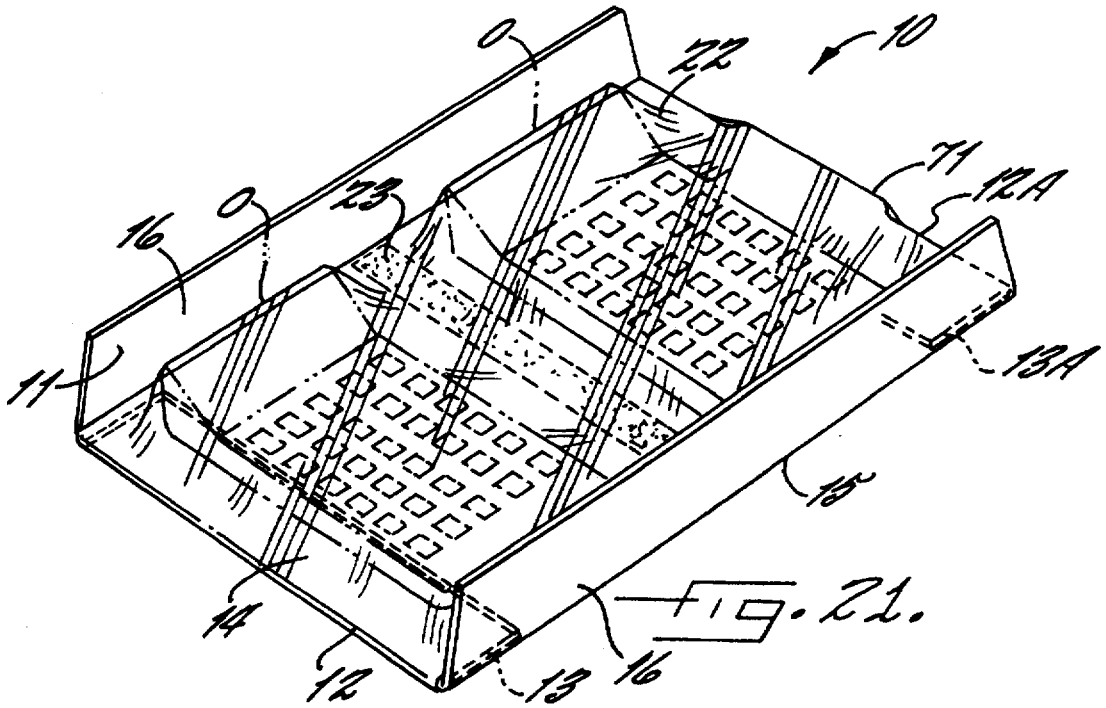
FIG. 21 is a perspective view of a ninth embodiment of the present invention illustrating two packaged objects.
Figure 22:
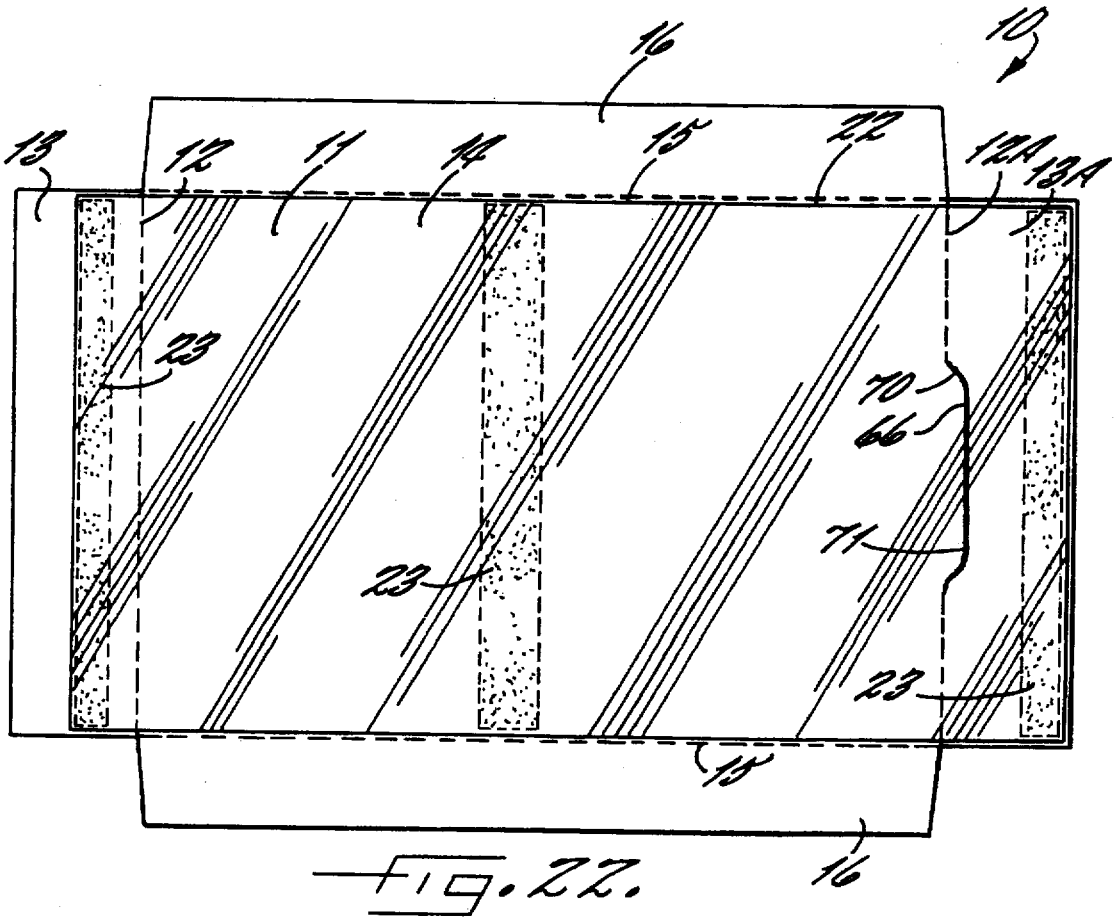
FIG. 22 is a top plan view of the ninth embodiment.

A ninth embodiment of the packaging structure 10 is illustrated in FIGS. 21 and 22. In particular, a tab-defining cut 70 is formed adjacent to one of the first pair of fold lines 12A. More specifically, a tab 71 extends from the center panel portion 14 into the folding side portion 13A so that, as the folding side portion is folded, the tension of the film material 22 is further increased. In accordance with the discussion above, the tab 71 increases the distance over which the film material 22 must extend when the folding side portion 13A is folded. This increased strain further tightens the film 22 against the object O being packaged. FIGS. 21 and 22 also illustrate the multiple pocket features of the third embodiment.

Figure 23:
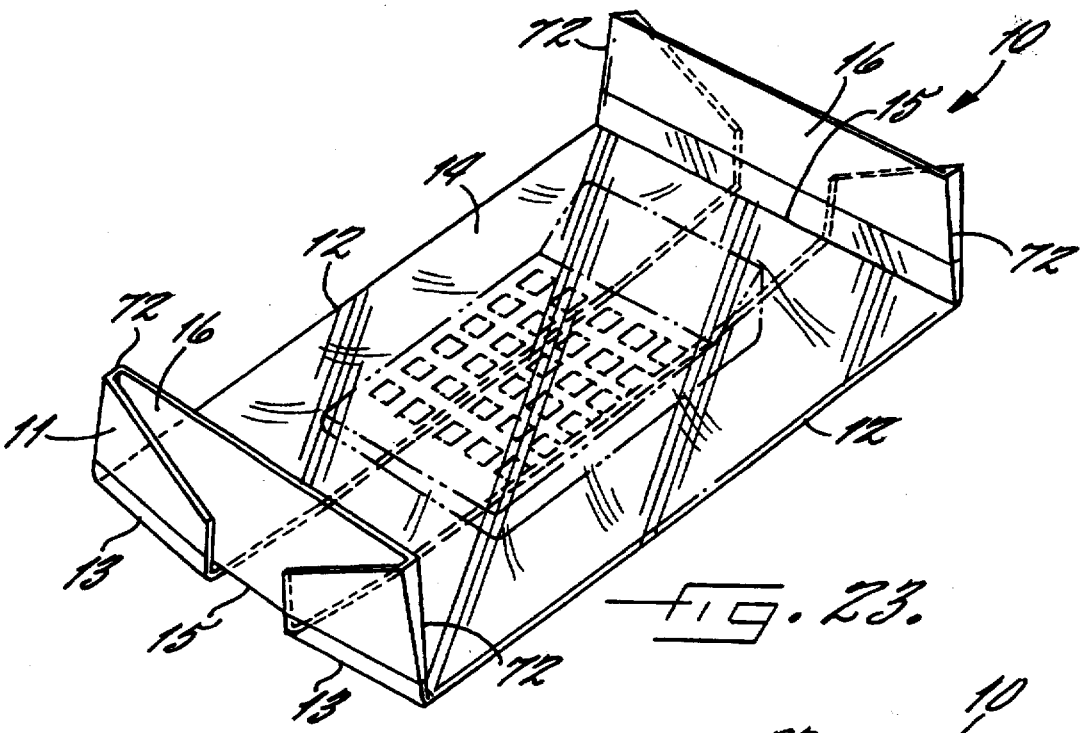
FIG. 23 is a perspective view of a tenth embodiment of the present invention.
Figure 24:
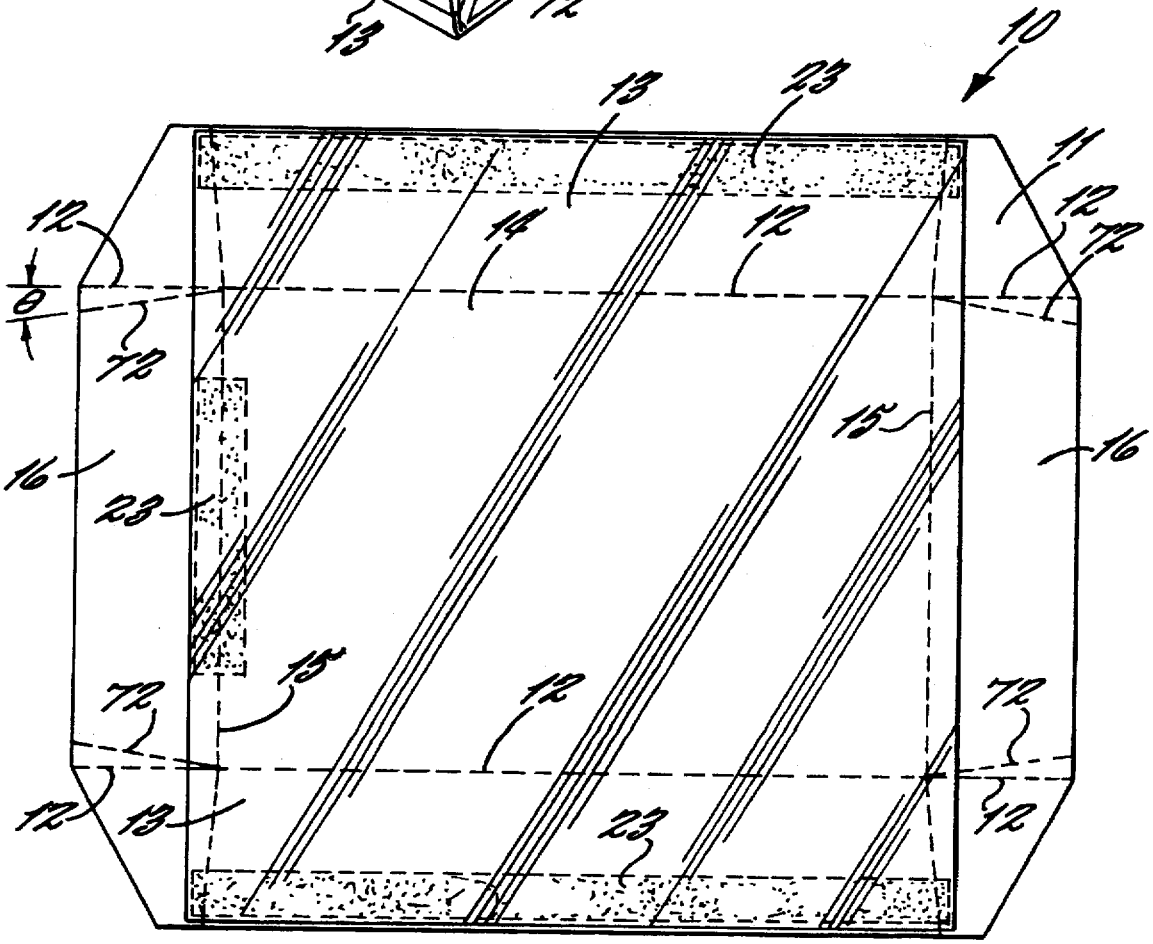
FIG. 24 is a top plan view of the tenth embodiment shown in an unfolded state.

A tenth embodiment of the packaging structure 10 is illustrated in FIGS. 23 and 24. The tenth embodiment includes four supplemental fold lines 72 extending from each of the intersections of the first 12 and second pairs 15 of fold lines. Each of the supplemental fold lines 72 extends at an acute angle θ from the first fold line 12 and towards the center of the distal edge of the respective folding end portion 16. Accordingly, when the packaging structure 10 is folded in the manner discussed above in connection with the first embodiment, the folding side portions 13 do not fold flat against the center panel portion 14 but define an acute angle θ therewith. The position of the side portions 13 thus spaces the center panel portion 14 from the bottom of the box 25. In addition, the resilient folding side portions 13 also perform a shock absorbing function with regard to the packaging structure 10.

Figure 25:
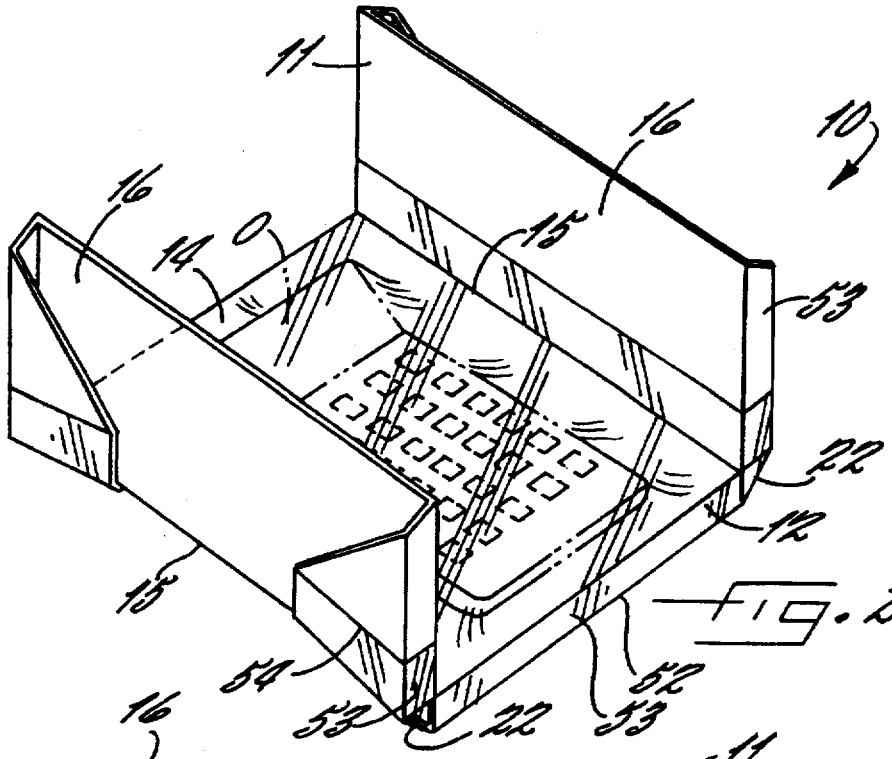
FIG. 25 is a perspective view of an eleventh embodiment of the packaging structure according to the present invention.
Figure 26:
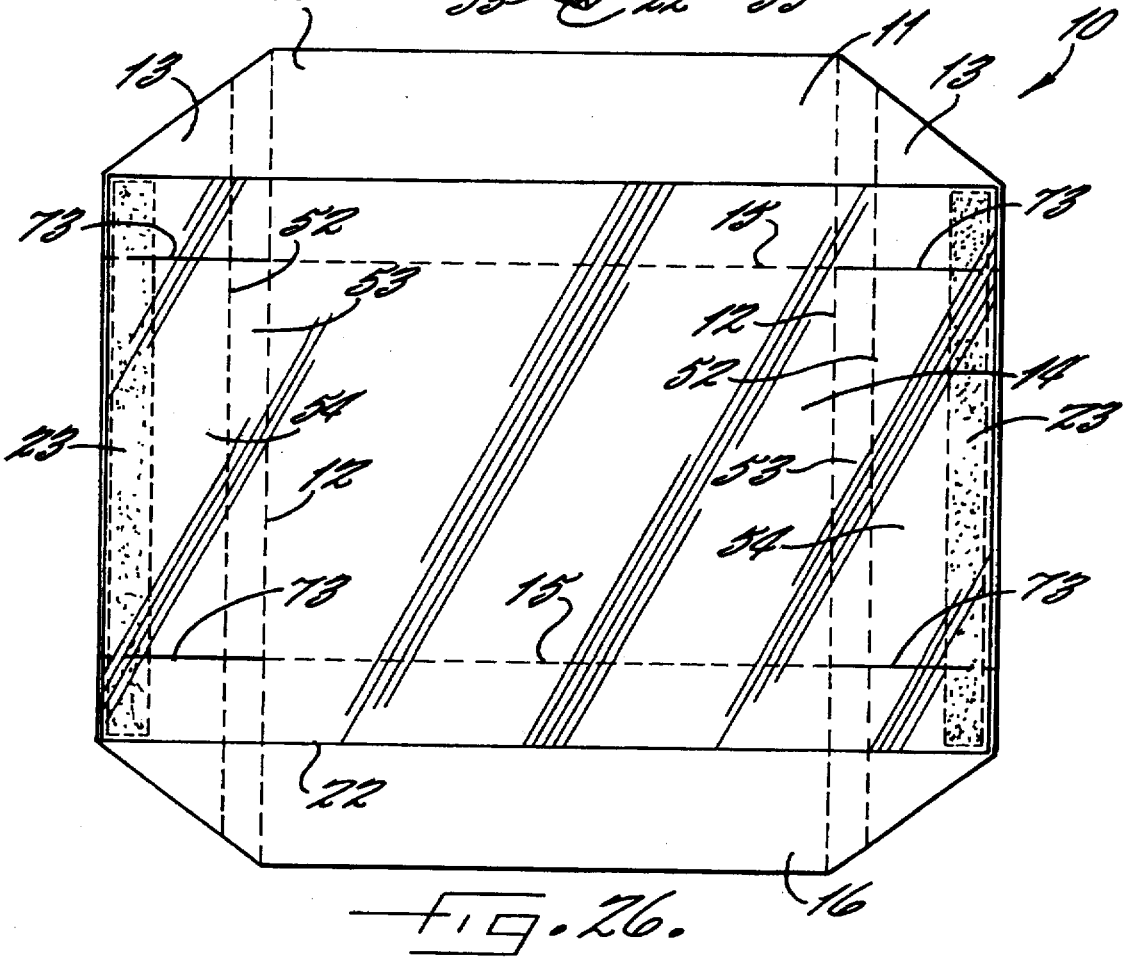
FIG. 26 is a top plan view of the eleventh embodiment.

An eleventh embodiment of the packaging structure 10 is illustrated in FIG. 25 and 26. The eleventh embodiment includes a third pair 52 of fold lines in the folding side portions 13 so as to define proximal 53 and distal 54 segments of the folding side portions 13. Four cuts 73 are formed and extend from the intersections of the first 12 and second 15 pairs of fold lines across the folding side portions 13. In other words, the cuts 73 replace the portion of the second fold lines 15 which would otherwise extend across the folding side portions 13. Thus, when the folding side portions 13 are folded downwardly and the folding end portions 16 are folded upwardly, in accordance with the discussion with regard to the first embodiment, the proximal segments 53 of the folding side portions extend perpendicular to the center panel portion 14. In addition, the distal segments 54 extend from the proximal segments 53 to the center panel portion 14 and are secured in this position by the tightened film 22. Thus, the proximal segments 53 form a spacer to space the center panel portion 14 from the bottom and sides of the box 25.

Figure 27:
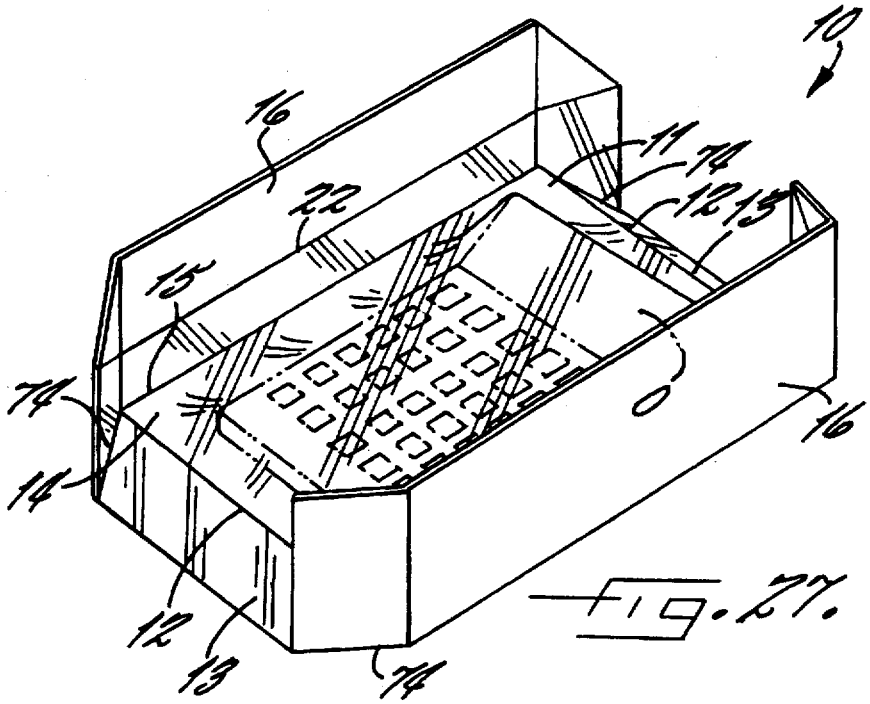
FIG. 27 is a perspective view of a twelfth embodiment of the present invention.
Figure 28:
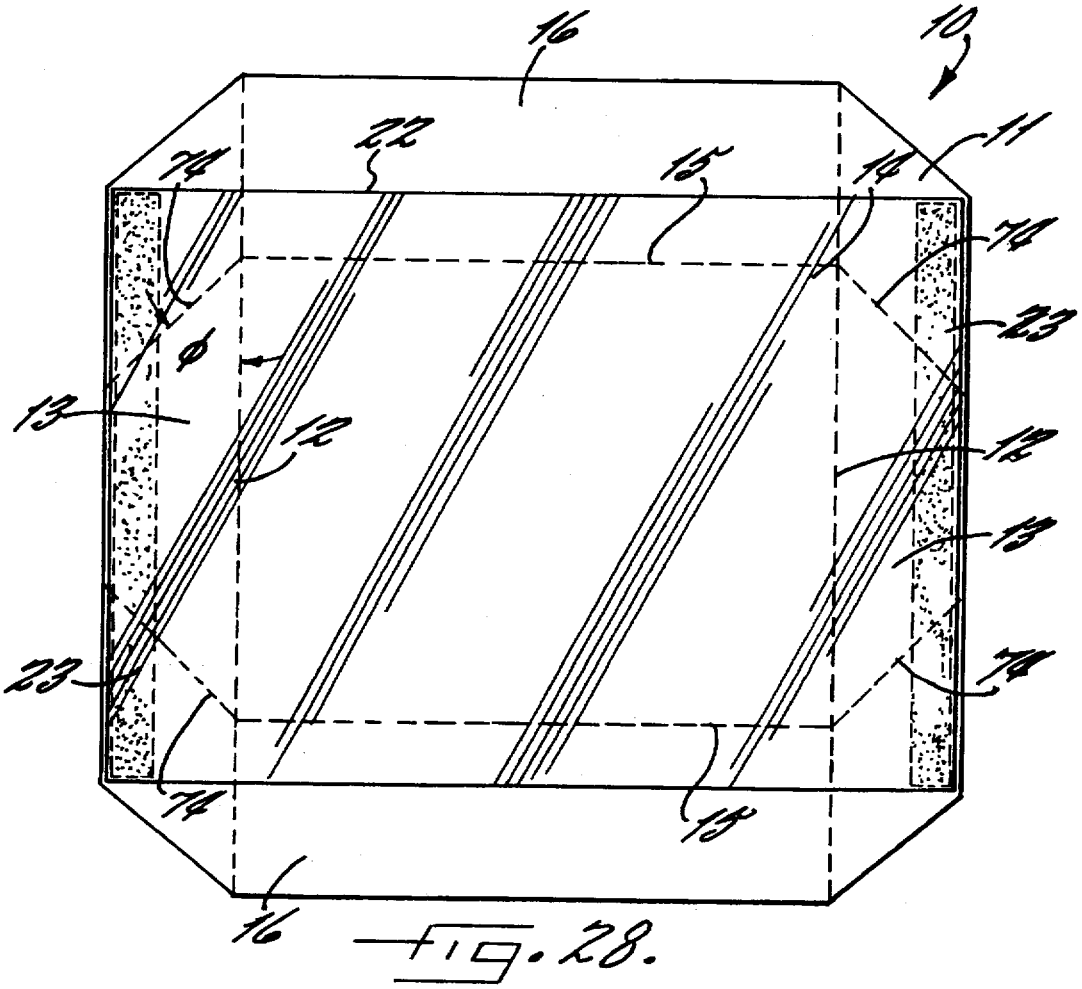
FIG. 28 is a top plan view of the twelfth embodiment.

A twelfth embodiment of the packaging structure 10 is illustrated in FIGS. 27 and 28. The second pair of fold lines 15 extend only along the center portion 14 of the panel 11 and terminate at the first pair of fold lines 12. Supplemental fold lines 74 are provided which extend from each of the ends of the second pair of fold lines 15 at an acute angle $\phi$ from the first fold lines 12 such that the supplemental fold lines 74 extend towards the center of the distal edge of the folding side portions 13. The supplemental fold lines 74 preferably extend at an acute angle $\phi$ of about 45° from the first pair of fold lines 12. Accordingly, as the folding side portions 13 are folded downwardly away from the plastic film material 22, the folding end portions 16 are caused to fold upwardly to the position shown in FIG. 27. The folding side portions 13, which can be folded downwardly no more than 90° because of their attachment to the folding end portions 16, thus form a spacer to space the center panel portion 14 from the bottom of the box 25.

Figure 29:
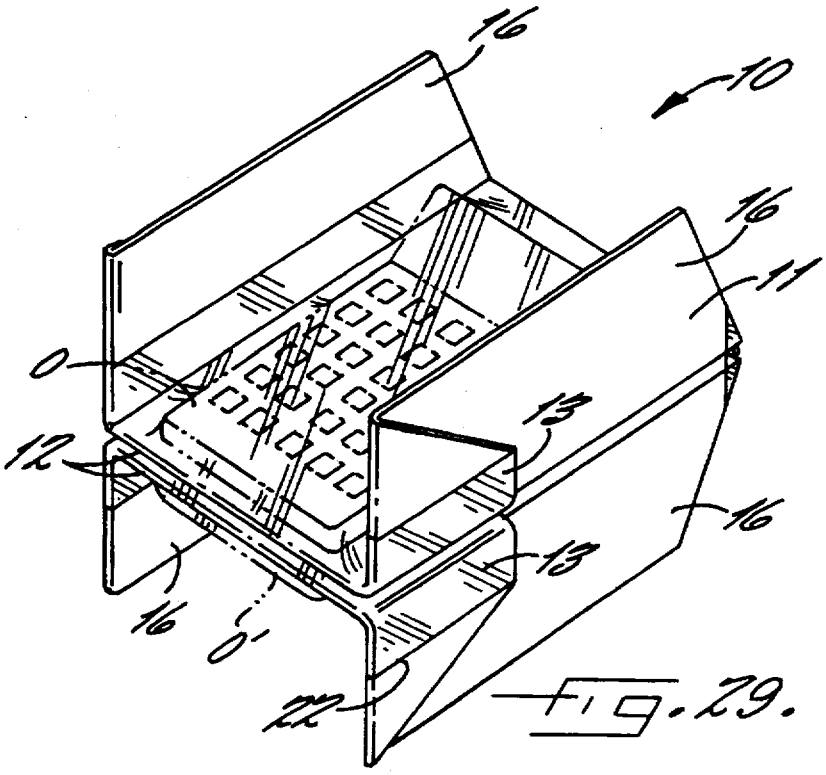
FIG. 29 is a perspective view of a thirteenth embodiment of the present invention illustrating two packaged objects.
Figure 30:
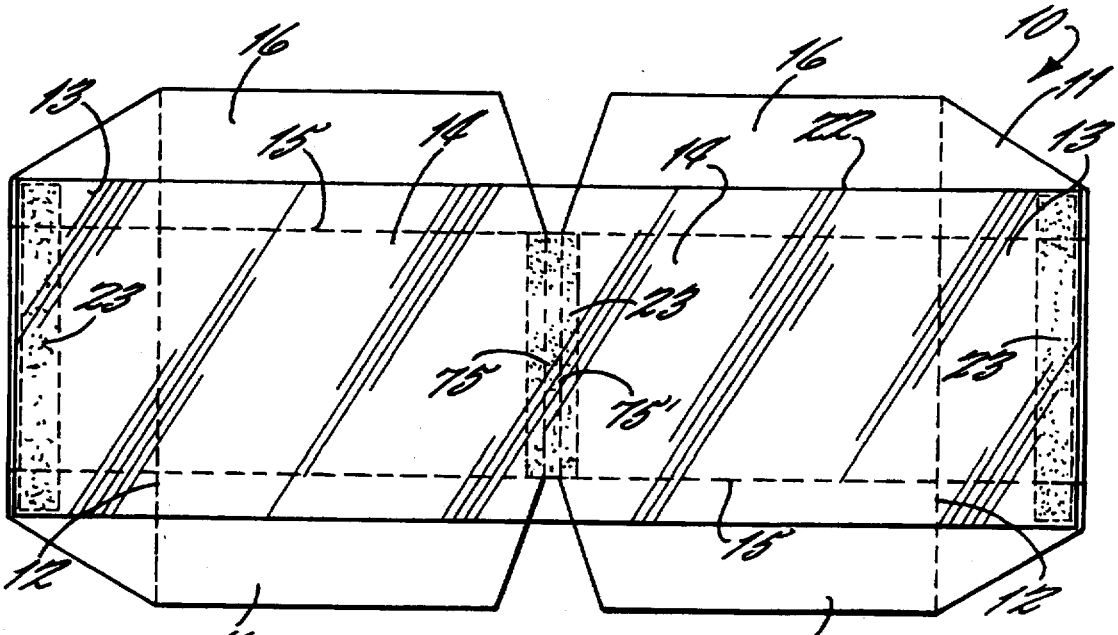
FIG. 30 is a top plan view of the thirteenth embodiment shown in an unfolded state.

A thirteenth embodiment of the packaging structure 10 of the present invention is illustrated in FIGS. 29 and 30. The thirteenth embodiment includes at least one central fold line 75 extending parallel to the first pair of fold lines 12. The central fold line may actually comprise two fold lines 75, 75' which are closely spaced to account for the center panel portion 14 thickness when folded in the manner discussed herein. The central fold line 75 thus defines a divided center panel portion 14 whereby objects O,O' may be held on each side of the central fold line 75. After objects O,O' have been inserted on each side of the central fold line 75 in the manner discussed above, the center portion 14 may be folded along the central fold line 75 so as to form the "H" shaped configuration shown in FIG. 29. The folding side portions 13 are first folded away from the plastic film material 22 and will be adjacent to each other when the center panel portion 14 is folded along the central fold line 75. Each of the folding end portions 16 may then be folded towards the plastic film material 22 so as to form the "H" shaped configuration illustrated in FIG. 29. The packaging structure 10 may then be placed into a box 25 such that one object O' will be disposed in the lower half of the box below the center panel portion 14 and the other object O will be disposed in the upper half of the box 24 above the center panel portion 14.

Figure 31:
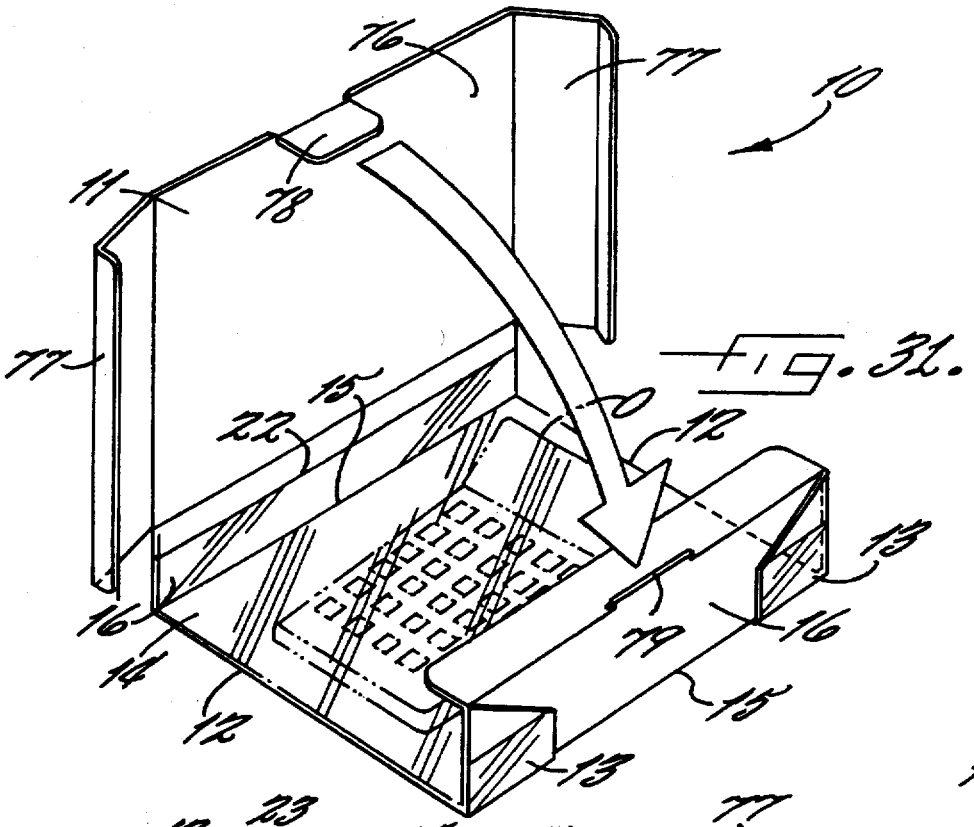
FIG. 31 is a perspective view of a fourteenth embodiment of the packaging structure of the present invention illustrating the closing of a box lid portion.
Figure 32:
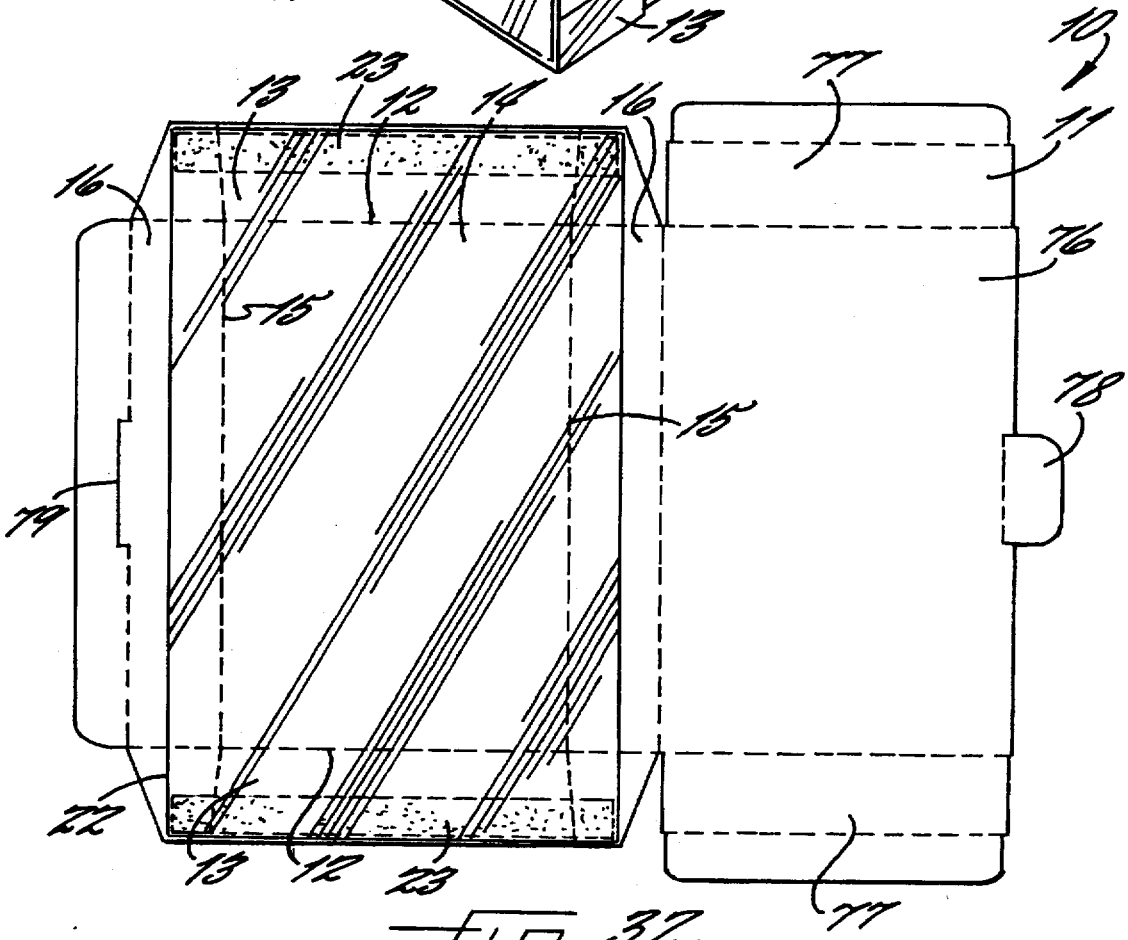
FIG. 32 is a top plan view of the fourteenth embodiment shown in an unfolded state.

A fourteenth embodiment of the packaging structure 10 is illustrated in FIGS. 31 and 32 and includes a box lid portion 76 attached to one of the folding end portions 16 for forming a self-contained box. The box lid portion 76 may include box side portions 77 attached thereto for forming the sides of the box when the box lid portion 76 is closed. The box lid portion 76 may also include a tuck tab 78 for receipt in a corresponding slot 79 in the folding end portion 16 so as to secure the box lid portion 76 and box side portions 77 in place. Accordingly, the fourteenth embodiment, when folded, constitutes a self-contained box and an external packing box 25 is not needed.

Figure 33:
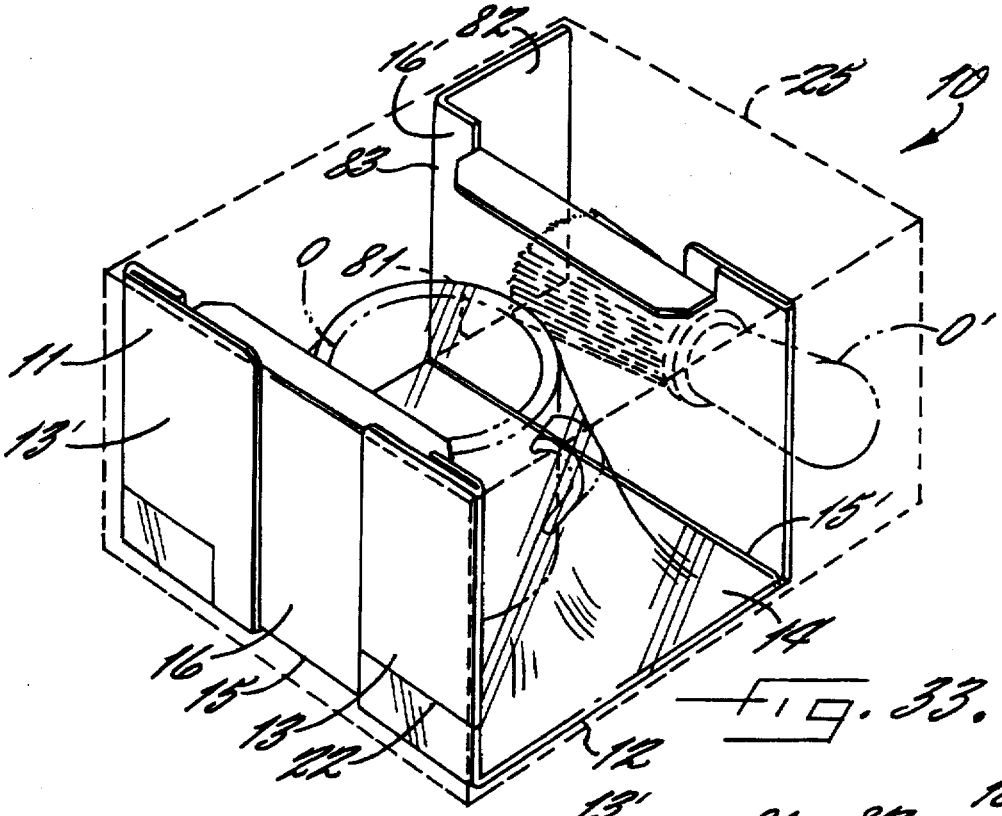
FIG. 33 is a perspective view of a fifteenth embodiment of the present invention illustrated within a protective box.
Figure 34:
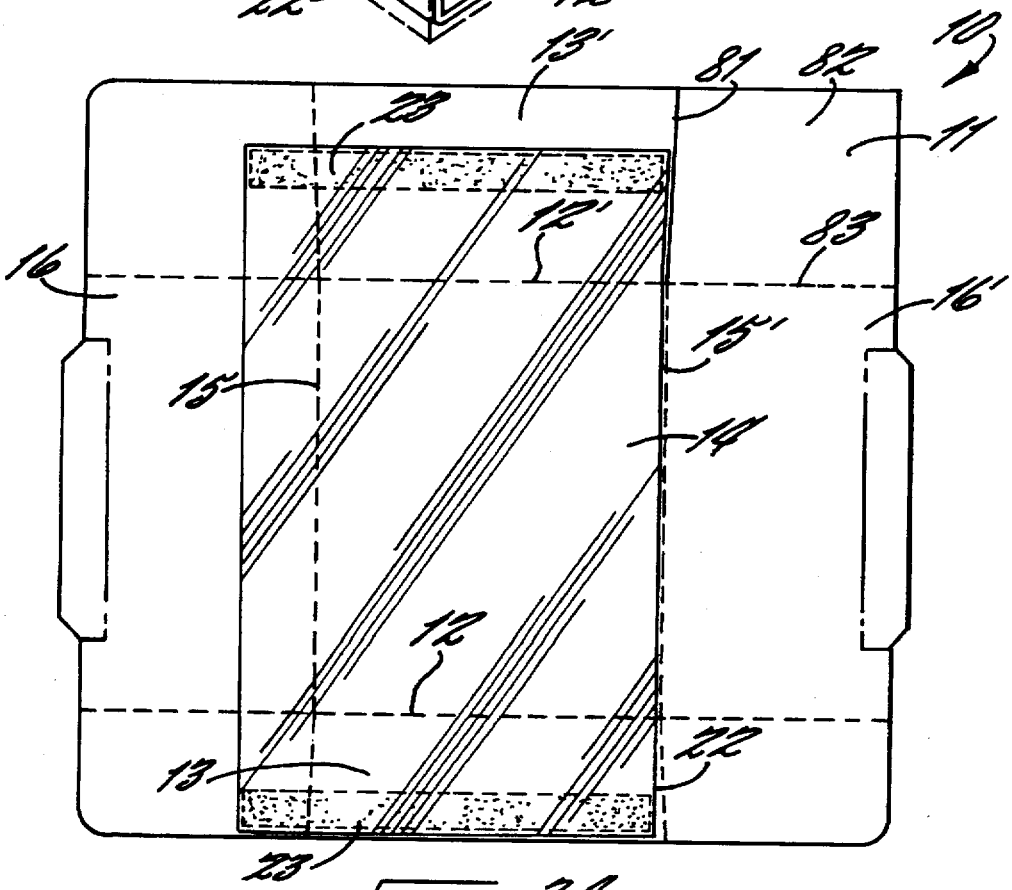
FIG. 34 is a top plan view of the fifteenth embodiment shown in an unfolded state.

A fifteenth embodiment of the packaging structure 10 is illustrated in FIGS. 33 and 34. The fifteenth embodiment includes a cut 81 formed in one of the folding side portions 13' and extending from one of the second pair of fold lines 15' to the distal edge of the folding side portion. Thus, the cut 81 forms a spacer tab 82 which is foldably connected to the adjacent folding end portion 16' byway of a portion 83 of the first fold line 12'. Accordingly, when the folding end portion 16' is folded upwardly towards the film 22, the spacer tab 82 may be folded away from the center panel portion 14 to the position shown in FIG. 33. The spacer tab 82 thus spaces the center panel portion 14 from an interior wall of the box 25. This may be advantageous when packaging two objects, one of which is fragile O, the other of which O' is not. For example, as shown in FIG. 33, a fragile shaving mug O may be placed against the center panel portion 14, but a less fragile shaving brush O' may be placed in the space created by the spacer tab 82 between the folding end portion 16' and the interior wall of the box 25. This can reduce packaging costs when it is not necessary to retain an object O' with the plastic film material 22.

Figure 35:
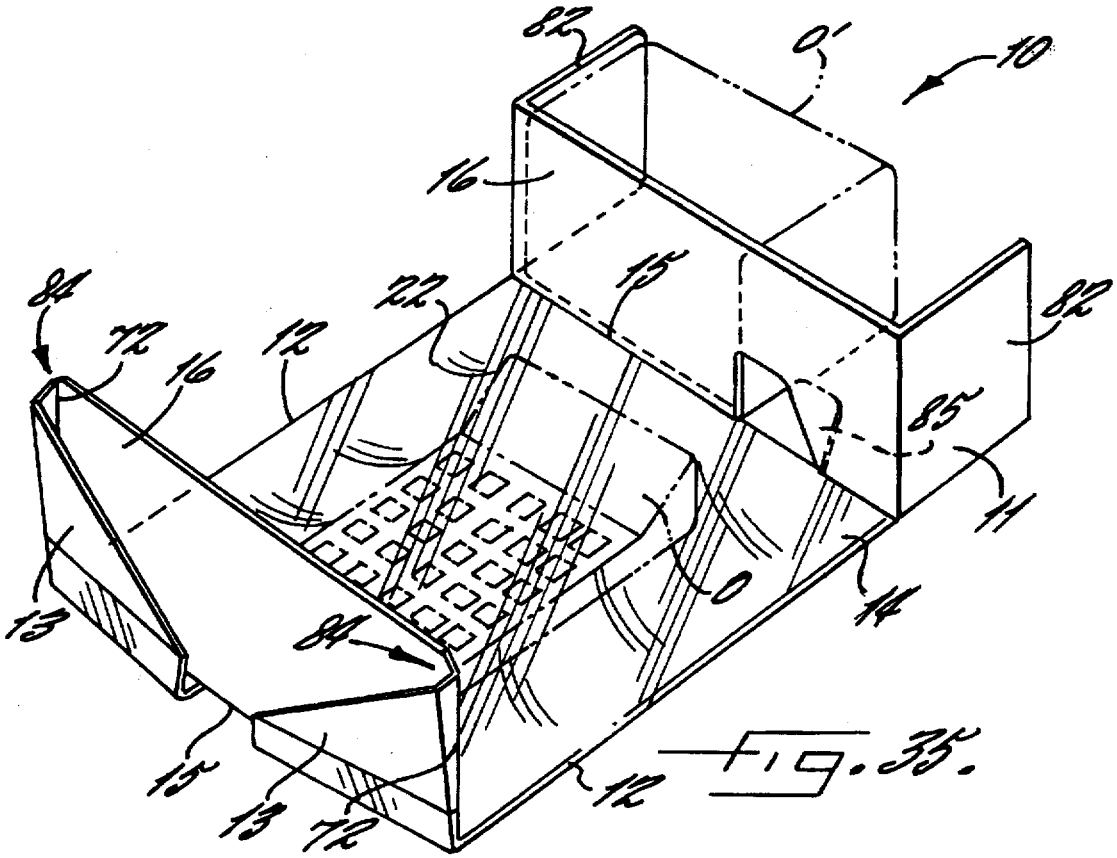
FIG. 35 is a perspective view of the sixteenth embodiment of the present invention.
Figure 36:
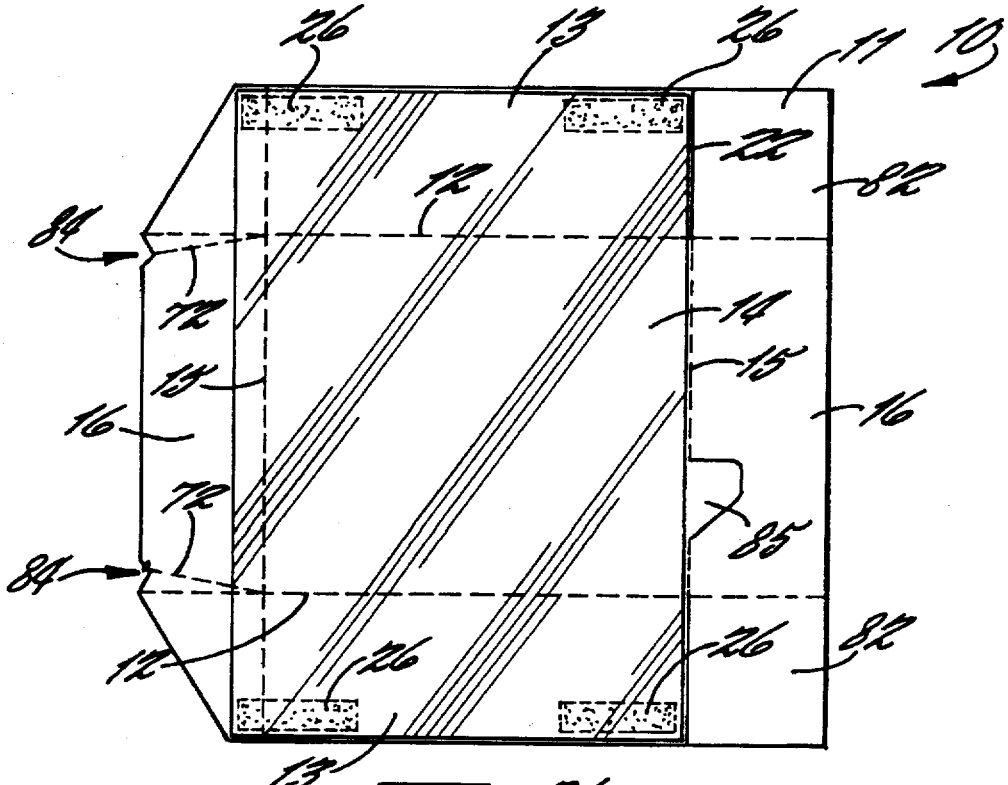
FIG. 36 is a top plan view of the sixteenth embodiment.

A sixteenth embodiment of the packaging structure 10 is illustrated in FIGS. 35 and 36, which is similar to the tenth embodiment illustrated in FIGS. 23 and 24. In the present embodiment, however, two notches 84 are formed in the distal edges of the folding end portions 16. These notches 84 shorten the length of the supplemental fold lines 72 relative to the adjacent portions of the first fold lines 12 and will thus more readily "break" (begin to fold) when the folding end portions 16 are folded upwardly towards the film 22. As illustrated, the sixteenth embodiment may also include two spacer tabs 82 of the type discussed above in connection with the fifteenth embodiment. A positioning tab 85 may also extend from the center panel portion 14 into the space created by the spacer tabs 82, to help position an object O' packaged in the space.

Figure 37:
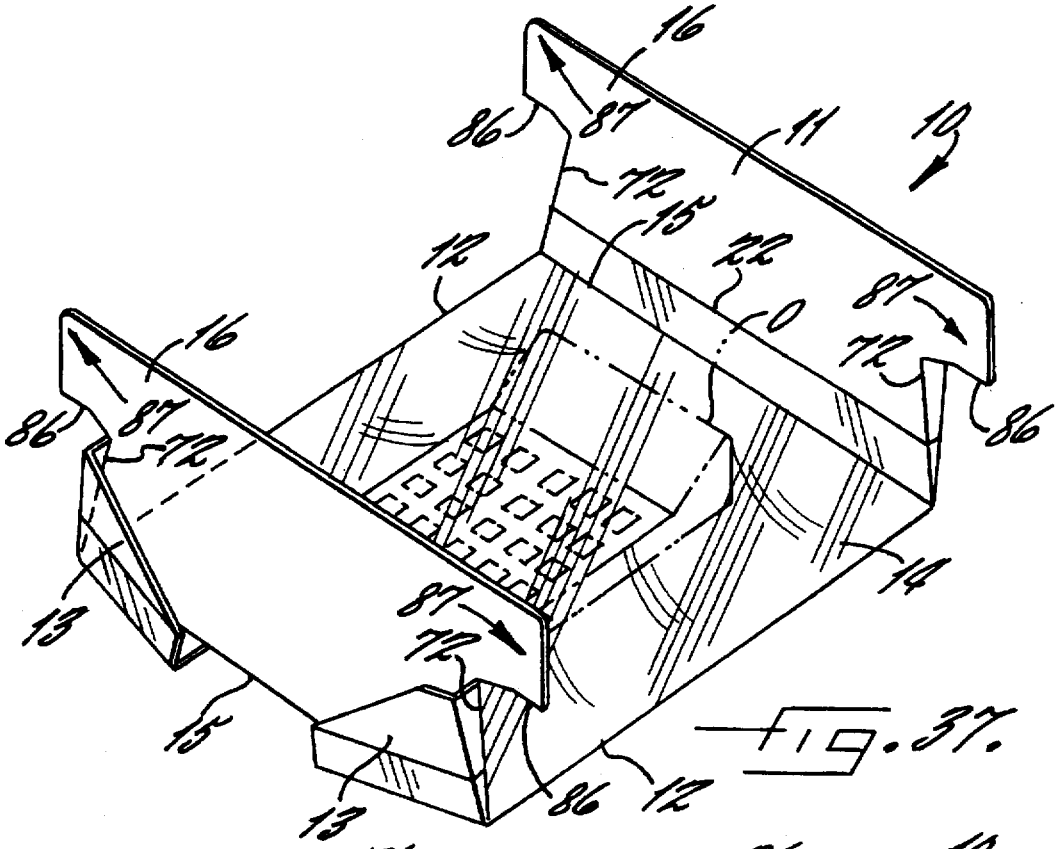
FIG. 37 is a perspective view of the seventeenth embodiment of the present invention.
Figure 38:
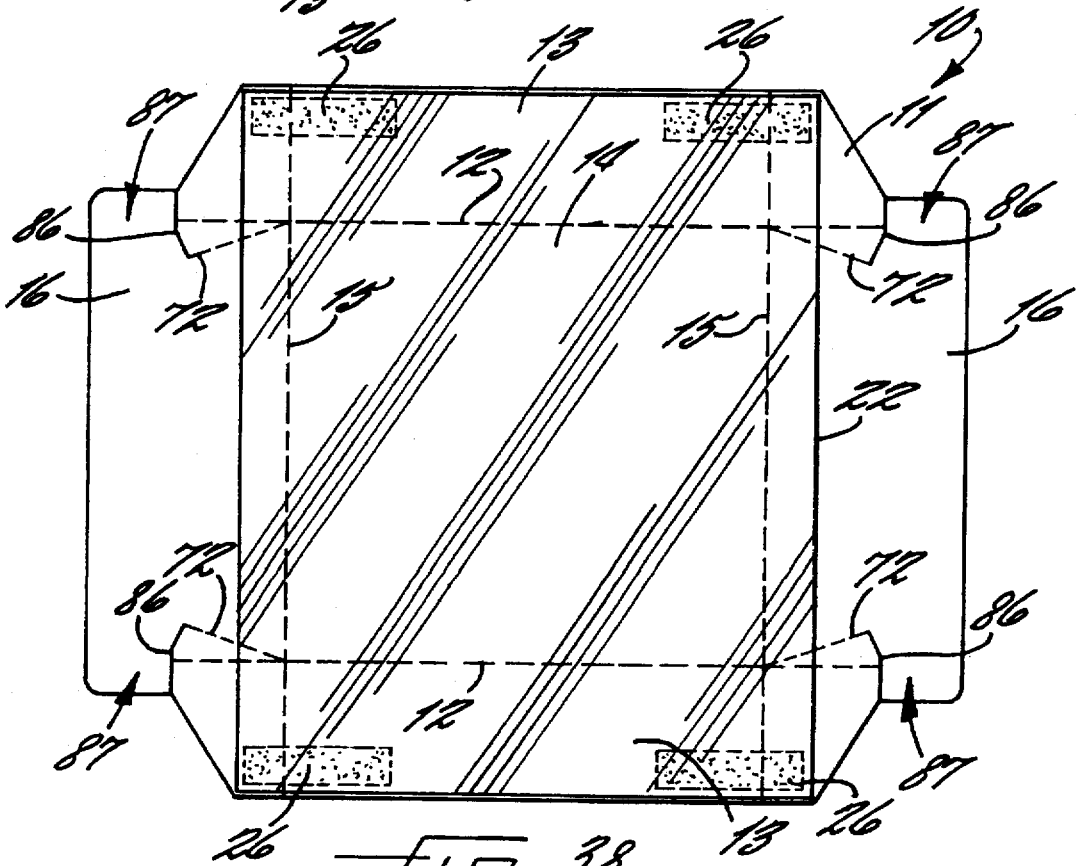
FIG. 38 is a top plan view of the seventeenth embodiment illustrated in an unfolded state.

A seventeenth embodiment of the packaging structure 10 is illustrated in FIGS. 37 and 38. The seventeenth embodiment is similar to the sixteenth embodiment in that it includes supplemental fold lines 72 which are shorter than the adjacent portions of the first pair of fold lines 12. In the seventeenth embodiment, however, cuts 86 are formed in the folding end portions 16 such that the supplemental fold lines 72 and the respective portions of the first fold lines 12 do not extend entirely across the folding end portions 16. Accordingly, when the folding end portions 16 are folded upwardly towards the film 22, they extend further upwardly than the ends of the first fold lines 12. In addition, the folding end portions 16 may extend further outwardly than the sides of the center panel portion 14 so that, when placed in a box 25, the projecting portions 87 of the folding end portions 16 contact the interior of the box. In this manner, the first pair of fold lines 12 are spaced from the interior of the box 25 and the center panel portion 14 does not directly contact the interior walls of the box at any point, thus further protecting the packaged object O.

Figure 39:
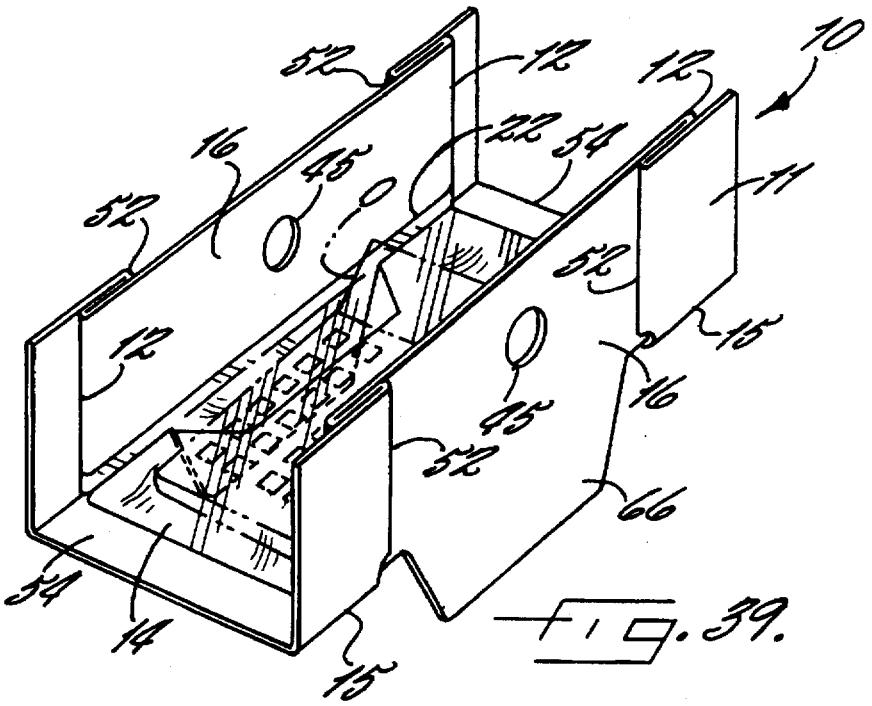
FIG. 39 is a perspective view of an eighteenth embodiment of the present invention.
Figure 40:
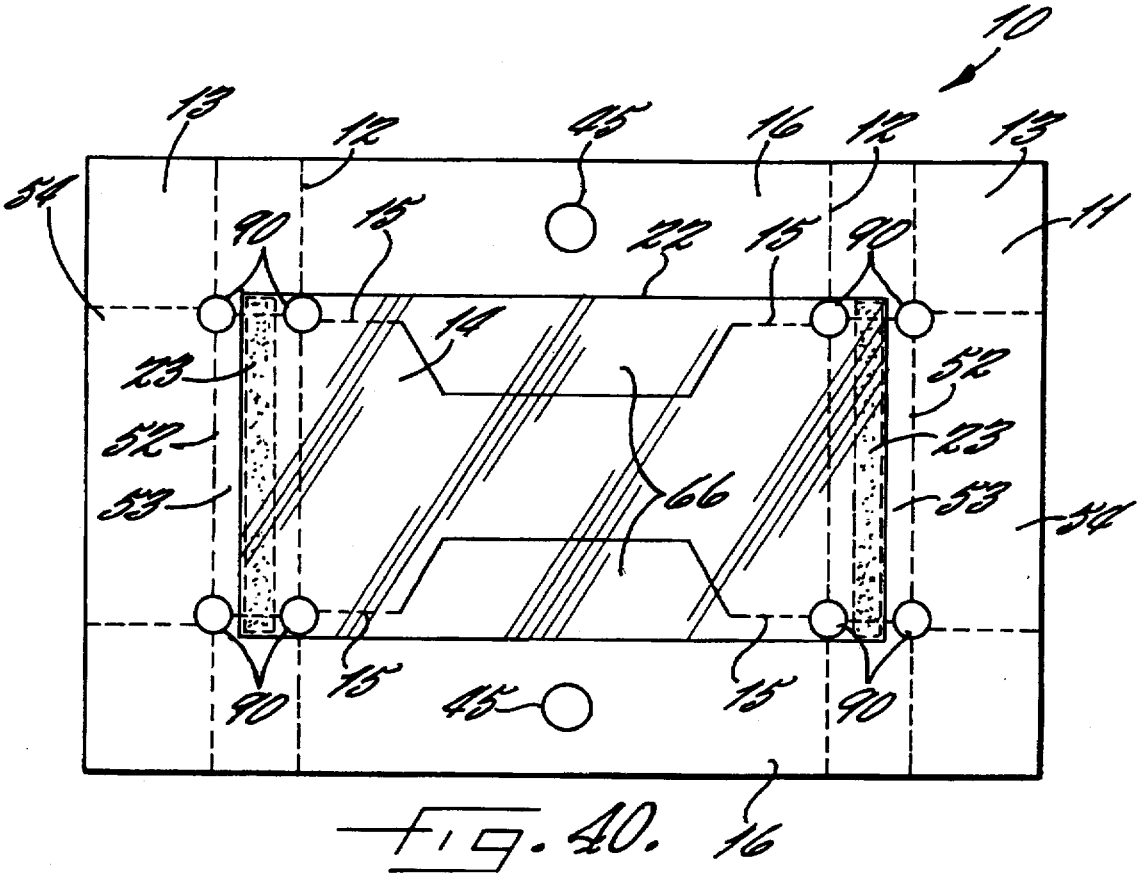
FIG. 40 is a top plan view of the eighteenth embodiment.

An eighteenth embodiment of the packaging structure 10 is illustrated in FIGS. 39 and 40 and includes a third pair of fold lines 52 located distally of both the first pair of fold lines 12 and the glue strips 23, thereby defining proximal 53 and distal 54 folding segments with the glue strips on the distal segments. The proximal segments 53 may first be folded in the manner discussed above so as to tighten the plastic film material 22 against the object O. The distal segments 54 may then be folded back in the opposite direction into the position shown in FIG. 39. It will be understood that this accordion-type folding enhances the shock absorbing function of the folding side portions 13, and it also serves to keep the center panel portion 14 away from the side of the box.

The eighteenth embodiment may also include holes 90 formed at the intersections of the second pair of fold lines 15 and the first 12 and third 52 pair of fold lines, so as to allow easier folding of the end portions 16 along the second pair of fold lines 15. The eighteenth embodiment also illustrates the handle holes 45 illustrated in the fifth embodiment in FIGS. 13 and 14. The drawings of the eighteenth embodiment also illustrate the vertical spacer tabs 66 of the eighth embodiment illustrated in FIGS. 19 and 20.

Figure 41:
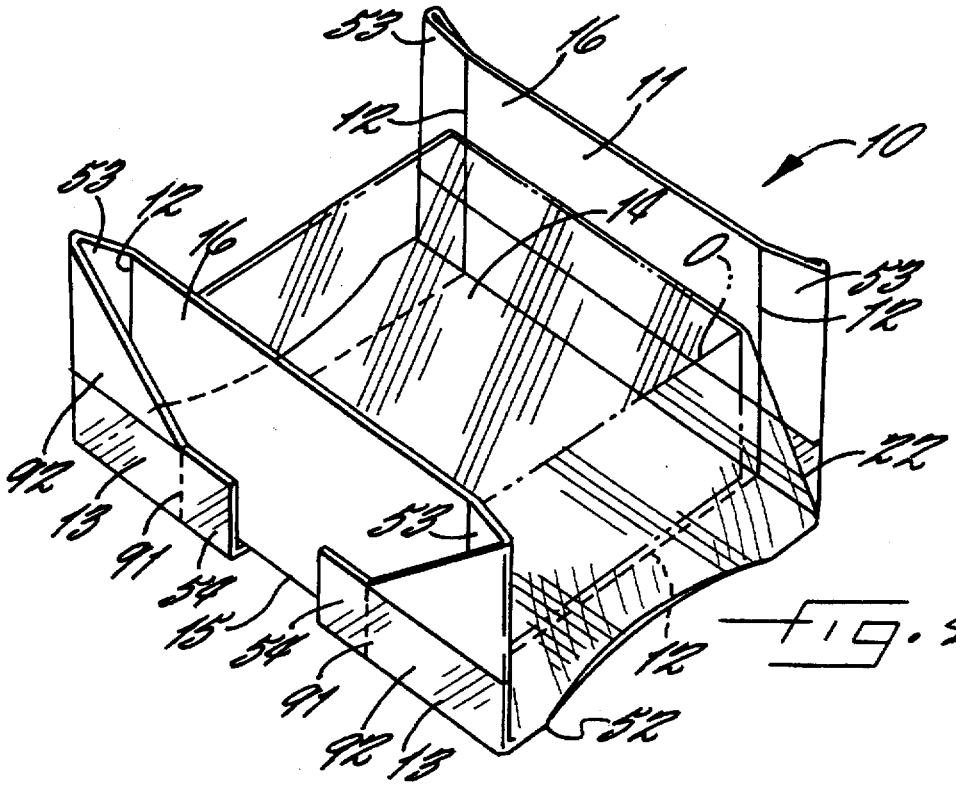
FIG. 41 is a perspective view of a nineteenth embodiment of the packaging structure of the present invention.
Figure 42:
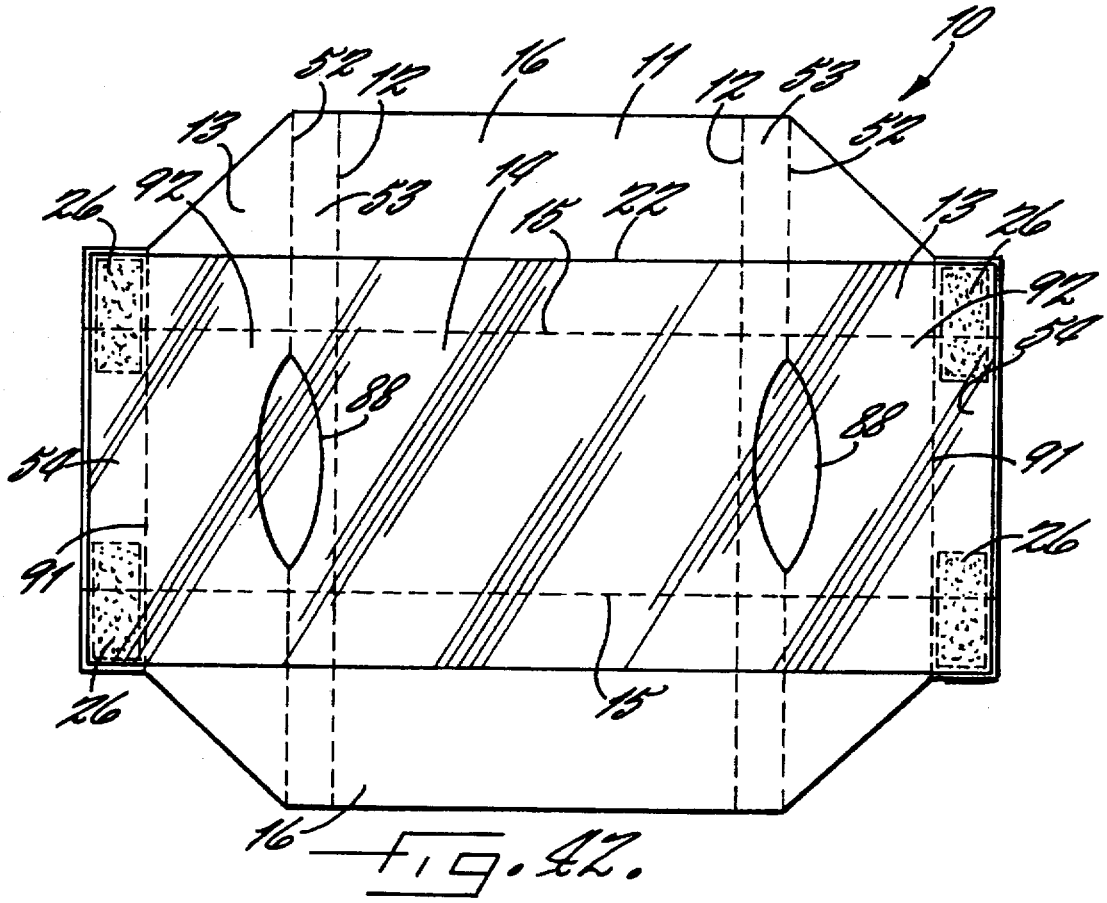
FIG. 42 is a top plan view of the nineteenth embodiment.

A nineteenth embodiment of the packaging structure 10 of the present invention is illustrated in FIGS. 41–43. The nineteenth embodiment includes an elliptical opening 88 formed in each of the folding side portions 13 along a third pair of fold lines 52. As such, the nineteenth embodiment is particularly useful for taller object O because, when the folding side portions 13 are folded along the third pair of fold lines 52, the openings 88 define a recess into which the plastic film material 22 may contract. Accordingly, the amount of tension applied to the object O across its mid-section is decreased because the circumferential distance about which the film 22 is drawn is smaller than the distance about which the film is drawn over the ends of the object.

Although one elliptical opening 88 is illustrated in each of the third pair of fold lines 52, it will be understood that the openings may have a different shape, number, and position. For example, the openings could be formed in the first pair of fold lines 12 to accomplish the same result.

Another notable feature of the nineteenth embodiment is the fourth pair of fold lines 91 formed in the folding side portions 13 immediately adjacent to the glue strips 23, thereby defining folding side portions having distal 54, medial 92, and proximal 53 segments. The securing power of a glue strip 23, in terms of the amount of tension which may be applied to the plastic film material 22, decreases as the angle $\gamma$ between the unsecured film and the glue strip increases. In other words, as the angle $\gamma$ of the tensile force approaches 90° relative to the glue strip 23, the plastic film material 22 is more likely to peel away from the glue strip. With taller objects O of the type illustrated in FIG. 43A, the angle $\gamma$ between the film material 22 and the folding side portion 13 is increased and may be large enough to cause the plastic film material 22 to peel away from the glue strip 23.

Figure 43A:
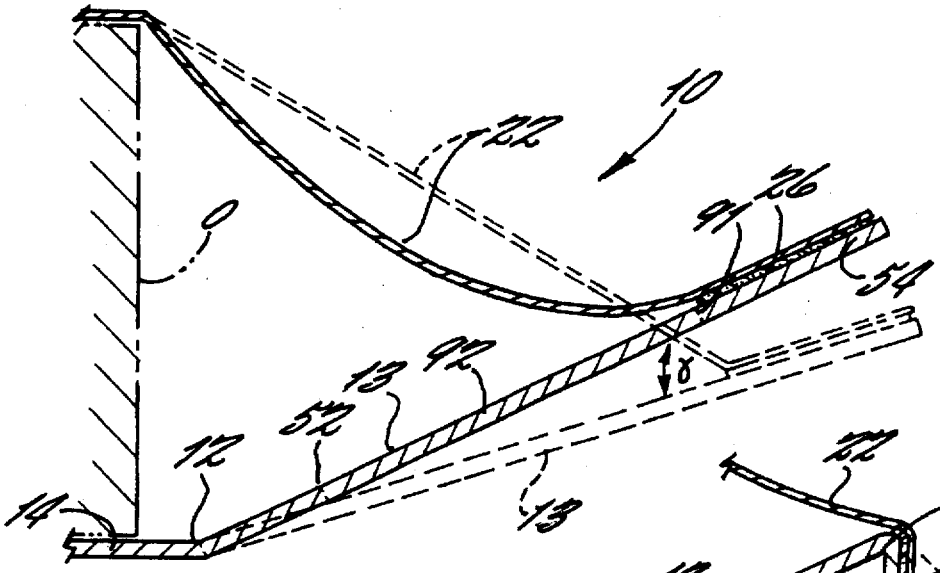
FIGS. 43A–43D are partial sectional views of the nineteenth embodiment illustrating the sequence used in folding the side portions.
Figure 43B:
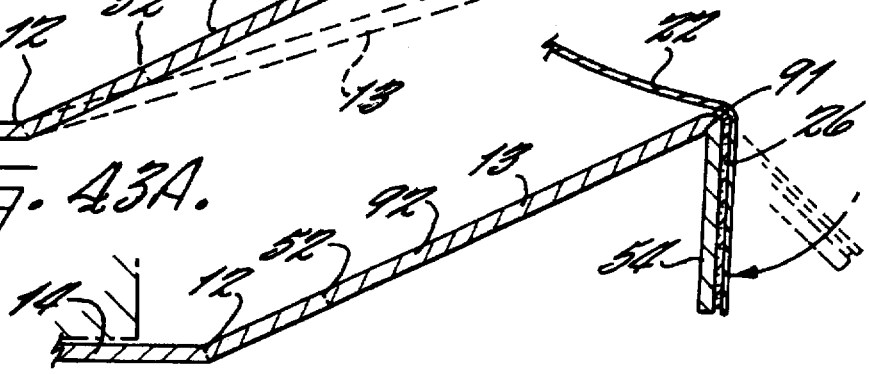

In the present embodiment of the invention, the smaller distal segments 54 may be folded under (away from the film 22) prior to folding the side portions 13 along the first 12 and third 52 pair of fold lines, as illustrated in FIG. 43B. After the distal segments 54 have been folded under, the tension angle $\gamma$ is substantially 0° because the plastic film material 22 is maintained flat against the entire distal segment. The proximal 53 and medial 92 segments may then be folded under as illustrated in FIG. 43C and distal segments 54 are folded back to a position coplanar with medial and proximal segments as illustrated in FIG. 43D.

Figure 43C:
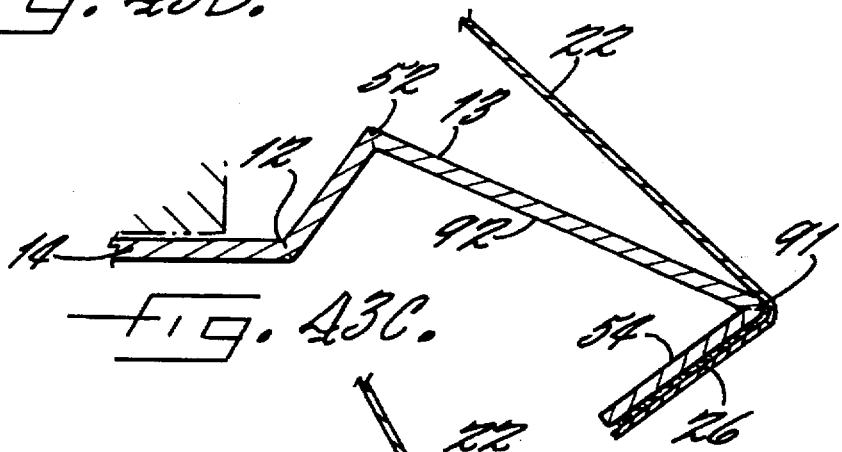
Figure 43D:
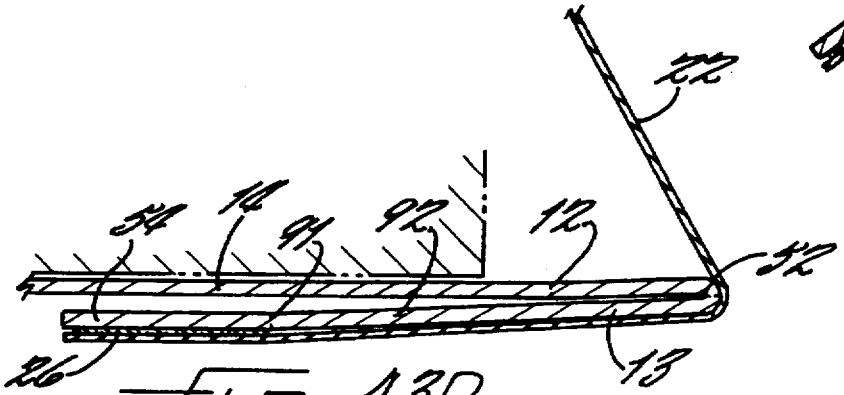

Additionally, as illustrated in the sequence of FIGS. 43B–43D, when the folding side portions 13 are folded under the center panel portion 14, the proximal segment 53 is folded slightly upwardly during the initial stages of the folding. As will be understood, however, after the plastic film material 22 is brought into contact with the entire medial portion 92, continued folding causes the proximal segment 53 to begin to fold downwardly in the opposite direction. This feature causes further increased tension in the plastic film material 22 and a more secure packaging of the object O.

Figure 44:
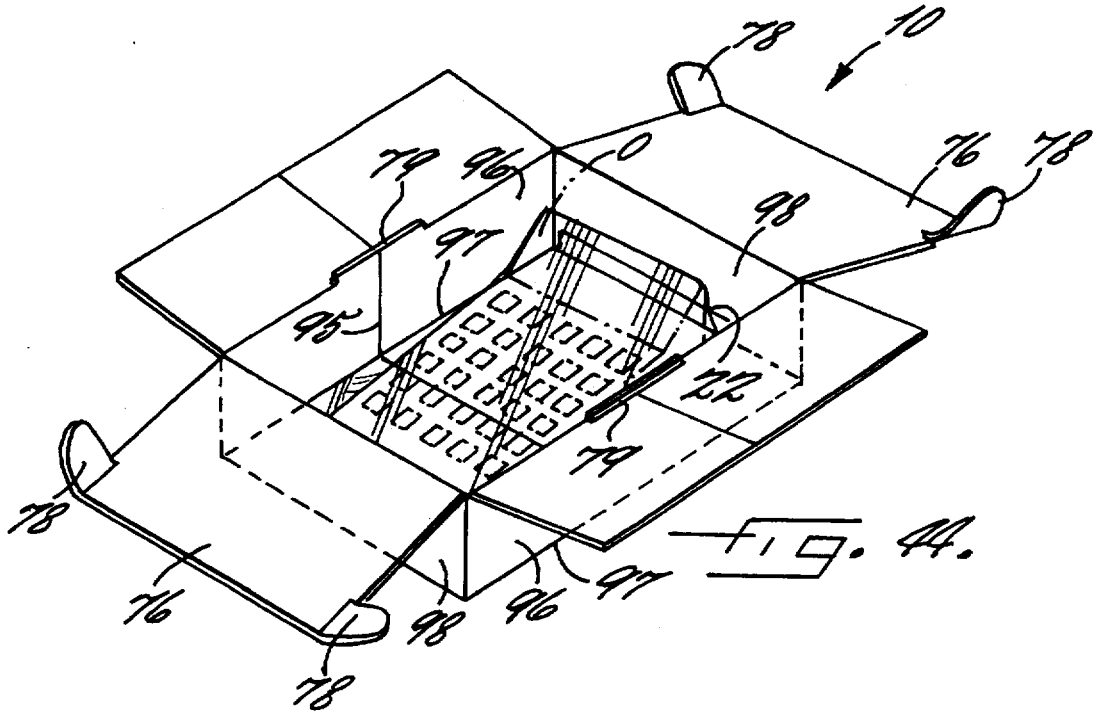
FIG. 44 is a perspective view of a twentieth embodiment of the present invention shown in a partially folded state.
Figure 45:
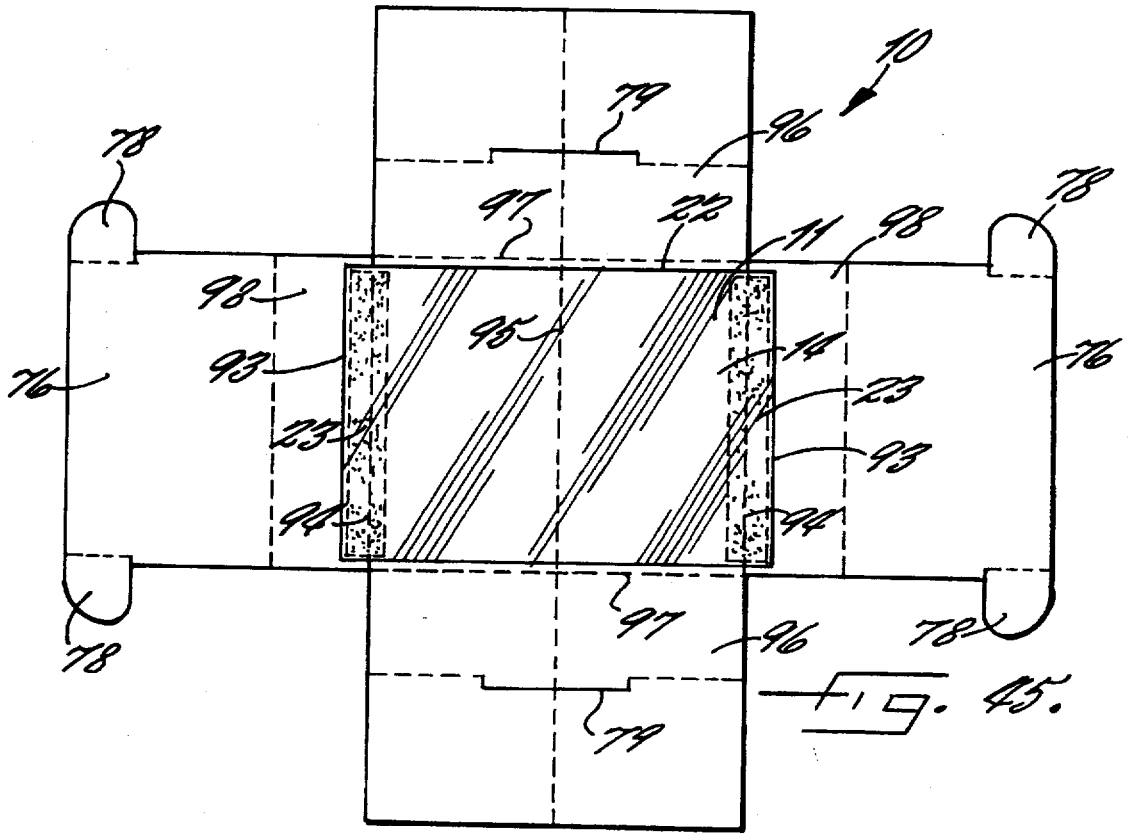
FIG. 45 is a top plan view of the twentieth embodiment.
Figure 46:
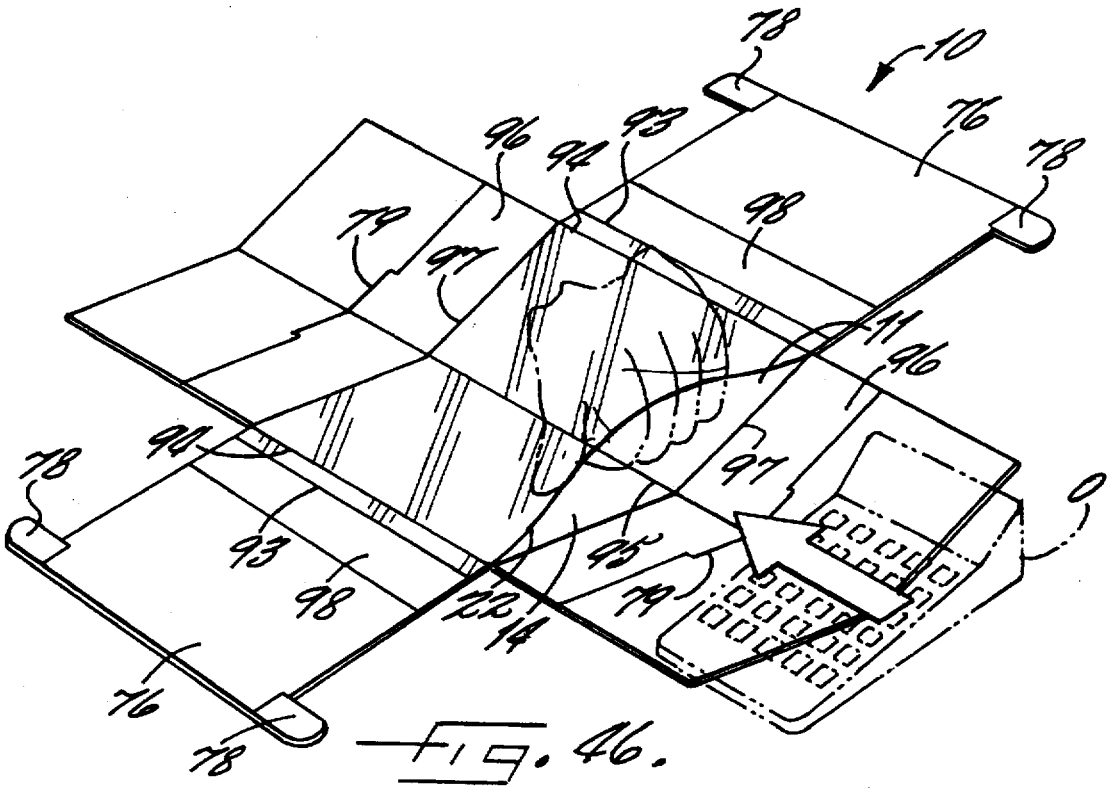
FIG. 46 is a perspective view of the twentieth embodiment illustrating the insertion of the object being packaged.

A twentieth embodiment of the packaging structure 10 of the present invention is illustrated in FIGS. 44–46 The twentieth embodiment includes a substantially rigid panel 11 having a planar center portion 14 against which the object O is to be packaged and a flexible film material 22 superimposed on one surface of the rigid panel and extending over the center portion. The twentieth embodiment includes adhesion means such as two glue strips 23, for securing at least two edge portions 93 of the film material to corresponding edge portions 94 of the center panel portion 14.

The twentieth embodiment also includes at least one fold line 95 extending through the center panel portion 14. The center panel portion 14 can be folded along this fold line 95 to bring the edge portions 94 of the center portion 14 and the secured edge portions 93 of the film 22 closer together as illustrated in FIG. 46. The film 22 is thus relaxed which permits an object O to be more easily inserted between the film and the center portion 14.

The twentieth embodiment also includes a pair of opposed end portions 96 which are attached to the center portion 14 along respective fold lines 97. These fold lines 97 are oriented transversely to the center fold line 95 so that, when the end portions 96 are folded upwardly along the fold lines 97, the center portion 14 is returned to a planar and unfolded state.

The twentieth embodiment may also include folding side portions 98 extending from the edge portions 94 of the center panel portion 14 adjacent to the glue strips 23. As illustrated in FIG. 45, the glue strips 23 may partially extend over both the center panel portion 14 and the folding side portions 98. When the folding end portions 96 and the folding side portions 98 are folded upwardly, as shown in FIG. 44, they may form the sides of a box. Each folding side portion 98 may also include a box lid portion 76 having a tuck tab 78 which may be retained in a slot 79 in the corresponding folding end portion 96.

Figure 47:
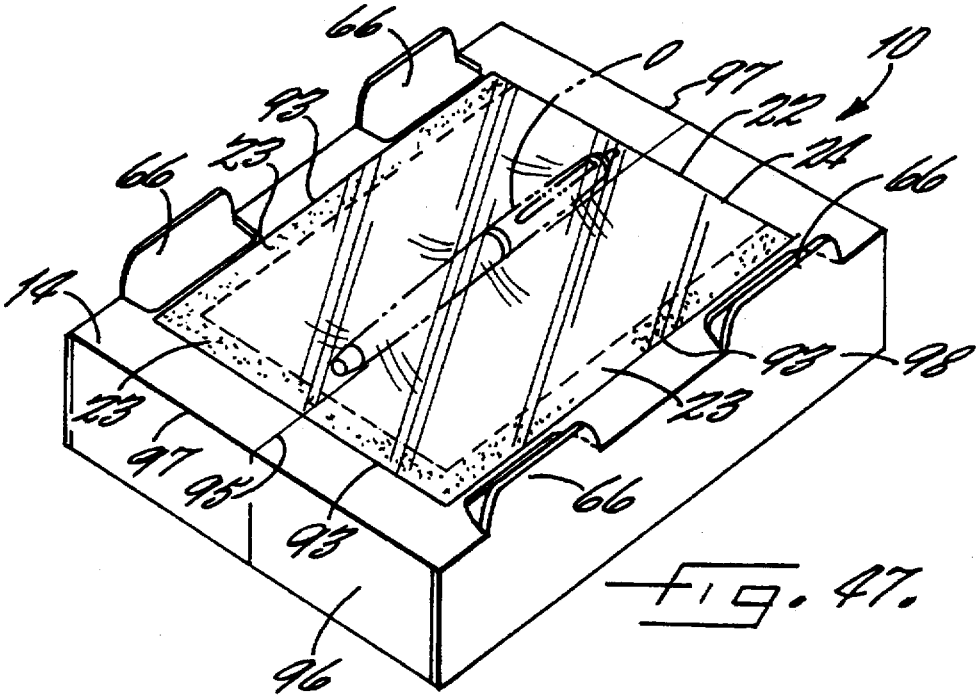
FIG. 47 is a perspective view of the twenty-first embodiment of the present invention.
Figure 48:
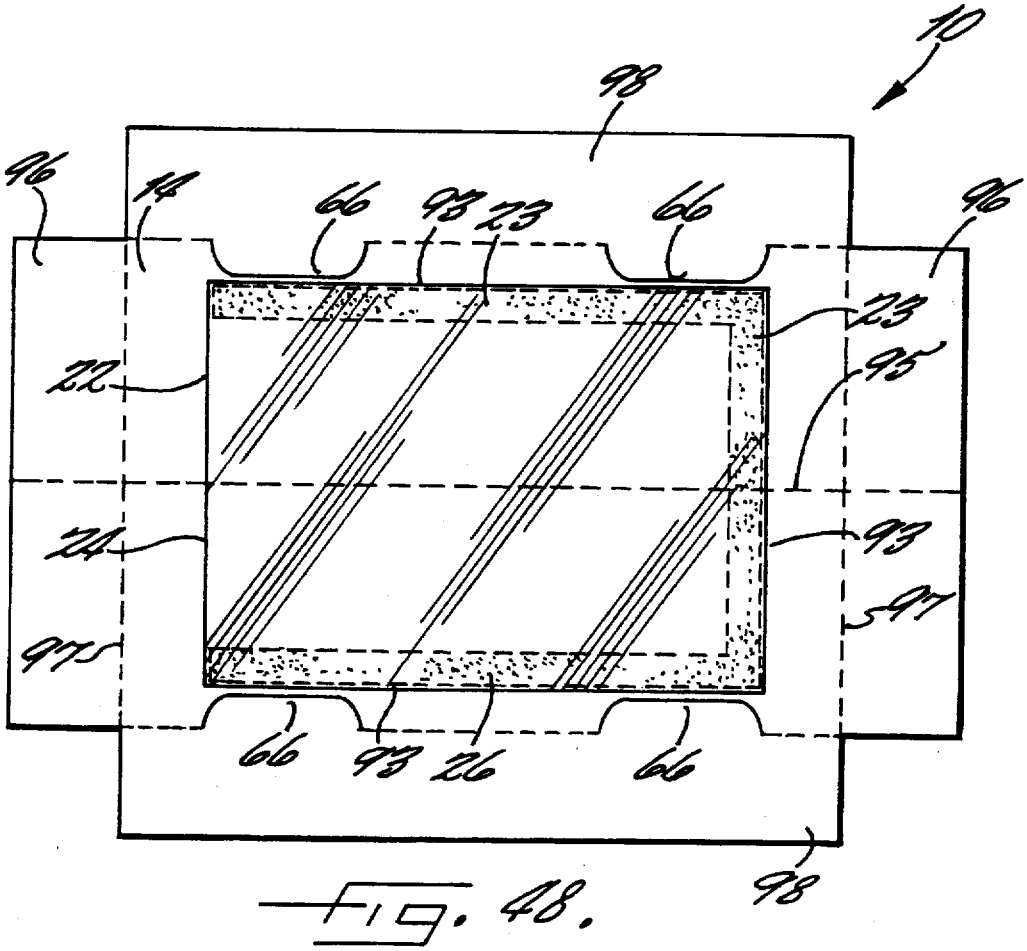
FIG. 48 is a top plan view of the twenty-first embodiment.

A twenty-first embodiment is illustrated in FIGS. 47 and 48. The twenty-first embodiment has the same basic structure as that of the twentieth embodiment, but includes four spacer tabs 66 in the folding side portions 98. When the folding end portions 96 and side portions 98 are folded downwardly as illustrated in FIG. 47, the structure 10 may be placed in a box, and the object O will be spaced from both the top and bottom interior walls of the box. In addition, this embodiment may include three glue strips 23, as shown in FIG. 48, for forming a pocket having one edge portion 24 open for receipt of the object O being packaged.

Figure 49:
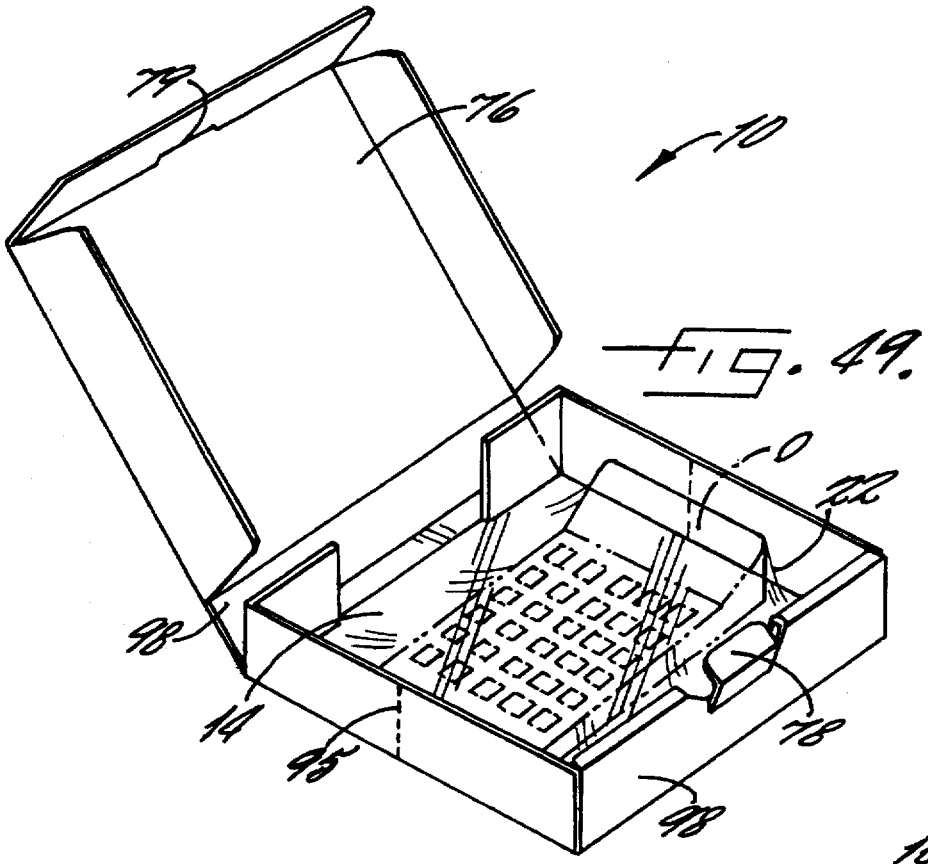
FIG. 49 is a perspective view of a twenty-second embodiment of the present invention.
Figure 50:
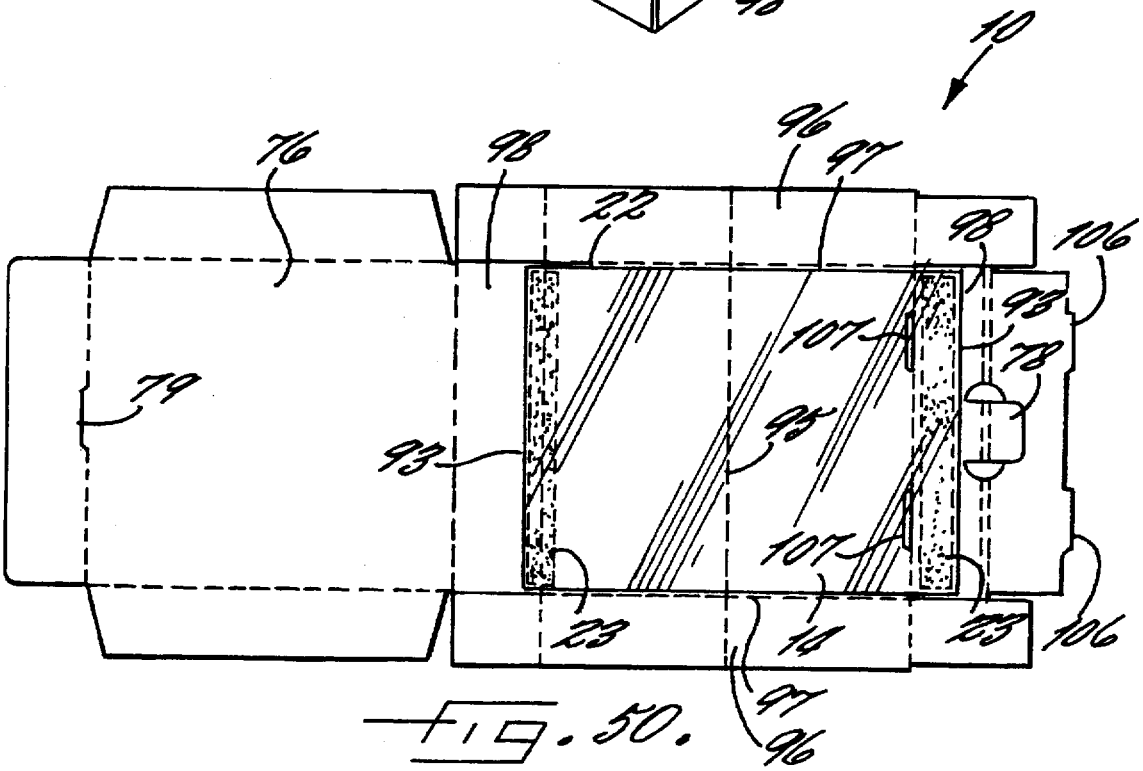
FIG. 50 is a top plan view of the twenty-second embodiment shown in an unfolded state.

A twenty-second embodiment is illustrated in FIGS. 49 and 50. The twenty-second embodiment includes a box lid portion 76 attached to one of the folding side portions 98 so as to form a self-contained box when folded. The opposite folding side portion 98 may include a tuck tab 78 for receipt in a corresponding slot 79 in the box lid portion 76 which secures the box in a closed position. The twenty-second embodiment also illustrates the film tightening projections 106 of a twenty-third embodiment as discussed below.

Figure 51:
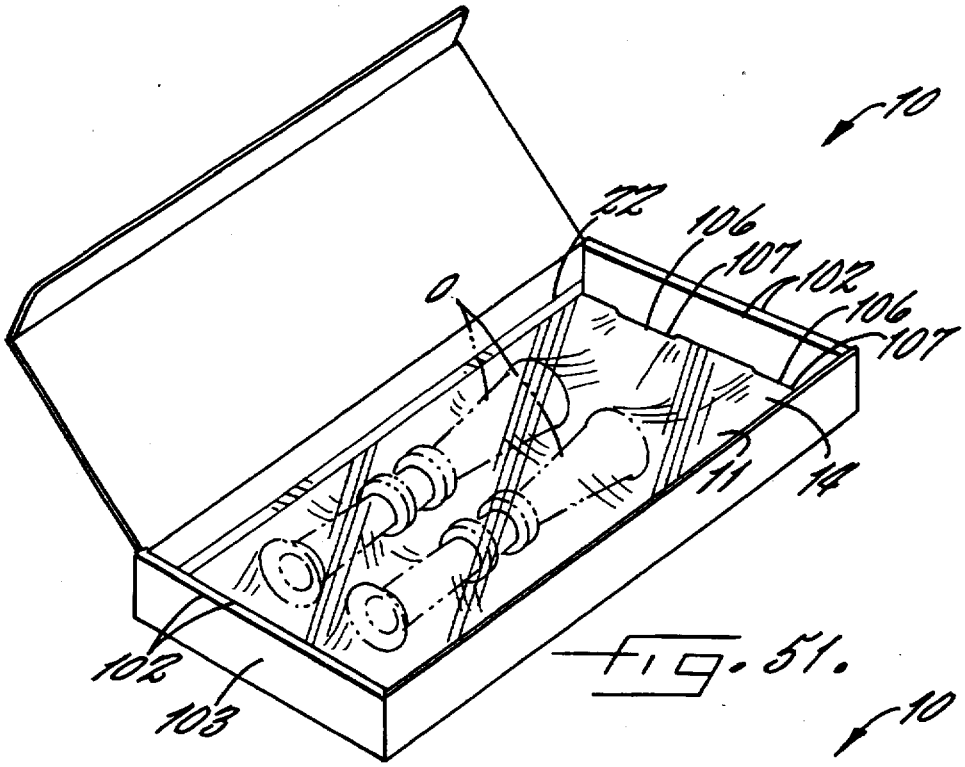
FIG. 51 is a perspective view of a twenty-third embodiment of the present invention.
Figure 52:
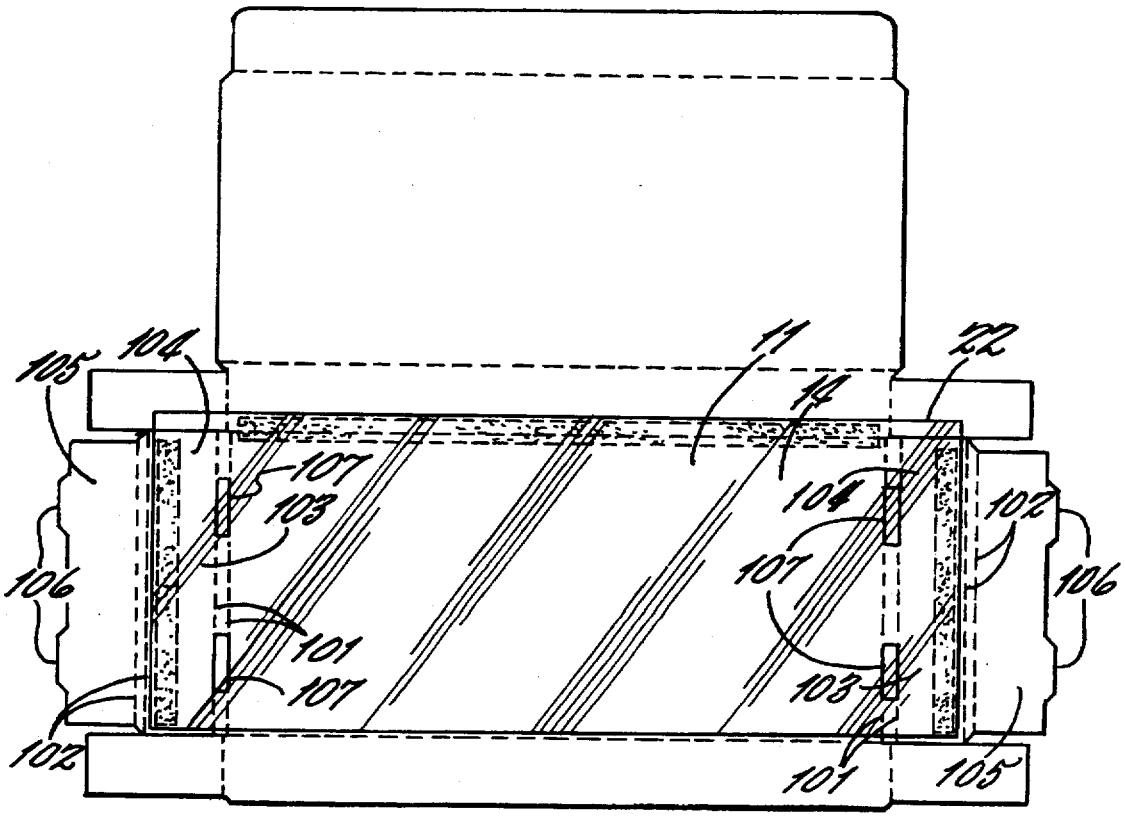
FIG. 52 is a top plan view of the twenty-third embodiment.

The twenty-third embodiment of the packaging structure 10 is illustrated in FIGS. 51 and 52 and includes a center panel portion 14 with a flexible film material 22 superimposed on one surface thereof. The rigid panel 11 includes first 101 and second 102 pairs of fold lines which define folding side portions 103 having proximal 104 and distal 105 segments. Each fold line may actually include two closely spaced sub-lines which account for the thickness of the rigid panel material.

The distal edges of the distal segments 105 include at least one film tightening projection 106 for receipt in a corresponding opening 107 formed in the center panel portion 14. As illustrated in FIG. 52, each distal segment 105 may include two projections 106 and the center panel portion 14 may include four openings 107. To construct the twenty-third embodiment, the proximal segment 104 is first folded upwardly towards the film 22. The distal segment 105 is then folded in the same direction so as to be flat against the film side of the proximal segment 104. The film tightening projections 106 are inserted into the openings 107 and force the plastic film 22 material into the openings. The resultant displacement of the film material 22 into the openings 107 causes the film material to be further tightened against the object or objects O being packaged.

An associated method for packaging an object also forms a part of the present invention and is directed to packaging an object O in a packaging structure 10 including a substantially rigid panel 11 having a pair of folding side portions 13 and a flexible film material 22 secured to the folding side portions. The method includes the steps of folding the side portions 13 in a direction toward the film 22, inserting the object O to be packaged between the film and the rigid panel 11, and then folding the side portions in the opposite direction to that of the first folding step. The side portions 13 are folded away from the film 22 until they are adjacent to the surface of the panel 11 which is opposite the film. The side portions 13 may then be secured in the folded position. The folded structure 10 can be placed into a box 25 for further handling and/or shipping.

In the drawings and specifications, there have been disclosed typical preferred embodiments of the invention and, although specific terms have been employed, they have been used in a generic and description sense only and not for purposes of limitation, the scope of the invention being set forth in the following claims:

That which is claimed:

1. A packaging structure for holding an object securely against a rigid backing, said packaging structure comprising:

a substantially rigid panel with a first pair of generally parallel fold lines adjacent opposite side edges of said panel that define respective folding side portions;

a second pair of fold lines in said rigid panel substantially parallel to one another and substantially perpendicular to said first pair of fold lines that define respective folding end portions in said rigid panel;

wherein said first and second pairs of fold lines define a center panel portion in said rigid panel, said center panel portion being substantially continuous;

a flexible film material superimposed on one surface of said rigid panel and extending over said center panel portion and past said first pair of fold lines onto said folding side portions of said rigid panel; and means for securing said film to said folding side portions of said rigid panel while defining at least one unsecured edge portion of said film adjacent to one of said second fold lines through which unsecured edge portion an object to be packaged can be inserted between said film and said center panel portion and for cooperating with said folding side portions to tighten said film against objects between said film and said center panel portion when said folding side portions are folded away from said film.

2. A packaging structure according to claim 1 wherein each said securing means comprises a glue strip extending along said folding side portion of said rigid panel.

3. A packaging structure according to claim 1 wherein said film further comprises a second unsecured edge portion, and wherein each said unsecured edge portion extends partially over one of said folding end portions.

4. A packaging structure according to claim 1 further comprising a third pair of generally parallel fold lines, one each of said third pair being formed in said folding side portions and generally parallel to said first pair of fold lines to thereby define proximal and distal folding segments in each of said folding side portions.

5. A packaging structure according to claim 1 further comprising a third pair of generally parallel fold lines, one each of said third pair being formed in said folding end portions and generally parallel to said second pair of fold lines to thereby define proximal and distal folding segments in each of said folding end portions.

6. A packaging structure according to claim 2 wherein each of said glue strips comprises a plurality of glue strip segments having unsecured portions of film therebetween.

7. A packaging structure according to claim 1 further comprising at least one glue strip securing a portion of said film to said center panel portion while leaving portions of said unsecured edge unsecured for defining at least two pockets between said film and said center panel portion, each having an unsecured film edge portion, for receiving therein separate objects to be packaged.

8. A packaging structure according to claim 1 wherein said flexible film comprises two laterally adjacent pieces of film on said center panel portion.

9. A packaging structure according to claim 8 wherein said two pieces of film partially overlap each other over said center panel portion.

10. A packaging structure according to claim 5 wherein each of said folding end portions comprises a pair of handle holes formed equidistant from the respective one of said third pair of parallel fold lines.

11. A packaging structure according to claim 1 further comprising means between one of said fold lines and said securing means for further increasing the tension in said film when said folding side portions are folded away from said film.

12. A packaging structure according to claim 11 wherein said tension increasing means comprises a tab-defining cut adjacent said one fold line for thereby defining a tab extending from said center panel portion that contacts and tightens said film against said center panel portion when said folding side portions are folded away from said film.

13. A packaging structure according to claim 1 wherein said first pair of fold lines is perpendicular to said second pair and portions of each first fold line extend onto said folding end portions thereby defining four fold line intersections, and further comprising supplemental fold lines extending from each of said intersections at an acute angle from said portions of said first fold lines and towards the center of the distal edge of said folding end portions whereby when said folding side portions are folded away from said film and said folding end portions are folded towards said film, so as to be perpendicular to said center panel portion, said folding side portions define an acute angle with said center panel portion.

14. A packaging structure according to claim 4 wherein said second pair of fold lines extend along said center panel portion and terminate at said first pair of fold lines, and further comprising cuts extending from each of the ends of the second pair of fold lines to the distal edge of said folding side portions whereby when said folding side portions are folded away from said film and said folding end portions are folded towards said film, so as to be perpendicular to said center panel portion, said proximal segments extend perpendicular to said center panel portion and said distal segments extend from said proximal segments to said center panel portion and are secured in place by said film.

15. A packaging structure according to claim 1 wherein said second pair of fold lines extend along said center portion of said panel and terminate at said first pair of fold lines, and further comprising supplemental fold lines extending from each of the ends of said second pair of fold lines at an acute angle from said first fold lines and towards the center of the distal edge of said folding side portions, whereby said folding end portions are folded towards said film when said folding side portions are folded away from said film.

16. A packaging structure according to claim 1 further comprising a central fold line extending parallel to said first pair of fold lines and defining a divided center portion for holding an object on each side of said central fold line when said center portion is folded along said central fold line and away from said film.

17. A packaging structure according to claim 1 further comprising a lid portion attached to one of said folding end portions so as to define a box when said folding end portions are folded towards said film and said lid portion is closed over said folding end portions.

18. A packaging structure according to claim 1 further comprising a cut formed in at least one of said folding side portions extending from one of said second pair of fold lines to the distal edge of said one folding side portion thereby defining a spacer tab foldably connected to the adjacent folding end portion by a portion of said first fold line, whereby said folding end portion is folded towards said film and said spacer tab is folded away from said center panel portion to space said center panel portion from an interior wall of a protective box.

19. A packaging structure according to claim 13 wherein said supplemental fold lines are shorter than said portions of said first fold lines extending onto said folding end portions.

20. A packaging structure according to claim 13 wherein said respective portions of said first fold lines do not extend entirely across said folding end portions.

21. A packaging structure according to claim 4 further comprising at least one opening formed in said folding side portion along at least one of said third pair of fold lines.

22. A packaging structure according to claim 4 further comprising a fourth pair of generally parallel fold lines, one each of said fourth pair being formed in said folding side portions and generally parallel to said first and third pairs of fold lines to thereby define proximal, medial and distal segments in each of said folding side portions.

23. A packaging assembly for holding an object securely against a rigid backing, said packaging assembly comprising:

a substantially rigid panel with a first pair of generally parallel fold lines adjacent opposite side edges of said panel that define respective folding side portions;

a second pair of fold lines in said rigid panel substantially parallel to one another and substantially perpendicular to said first pair of fold lines that define respective folding end portions in said rigid panel;

wherein said first and second pairs of fold lines define a center panel portion in said rigid panel, said center panel portion being substantially continuous;

a flexible film material superimposed on one surface of said rigid panel and extending over said center panel portion and past said first pair of fold lines onto said folding side portions of said rigid panel;

means for securing said film to said folding side portions of said rigid panel while defining at least one unsecured edge portion of said film adjacent to one of said second fold lines through which unsecured edge portion an object to be packaged can be inserted between said film and said center panel portion and for cooperating with said folding side portions to tighten said film against objects between said film and said center panel portion when said folding side portions are folded away from said film; and a box having interior dimensions corresponding to the peripheral dimensions of said rigid panel when folded so that said rigid panel can be securely held within the box.

24. A packaging assembly according to claim 23 further comprising a third pair of generally parallel fold lines, one each of said third pair being formed in said folding side portions and generally parallel to said first pair of fold lines to thereby define proximal and distal folding segments in each of said folding side portions.

25. A packaging assembly according to claim 23 further comprising a third pair of generally parallel fold lines, one each of said third pair being formed in said folding end portions and generally parallel to said second pair of fold lines to thereby define proximal and distal folding segments in each of said folding end portions.

26. A packaging structure for holding an object securely against a rigid backing, said packaging structure comprising;

a substantially rigid panel having a center panel portion and an opening formed therein adjacent to one end of said center panel portion;

a first fold line adjacent to said opening and defining a folding side portion;

a second fold line in said folding side portion generally parallel to said first fold line thereby defining proximal and distal folding segments in said folding side portion;

a flexible film material superimposed on one surface of said rigid panel and extending over said center panel portion and past said first fold line onto said folding side portion;

means for securing said film to said folding side portion while defining at least one unsecured edge portion of said film through which unsecured edge portion an object to be packaged can be inserted between said film and said center panel portion; and a projection on said distal folding segment adapted for being received in said opening when said proximal segment is folded towards said film and said distal segment is folded against said proximal segment thereby causing said film to be pressed against the opening and tightened against the object being packaged.

27. A method for packaging an object in a packaging structure including a substantially rigid panel having a pair of folding side portions, a pair of folding end portions, and a flexible film material secured to the folding side portions and defining at least one unsecured edge portion adjacent a respective folding end portion, the method comprising the steps of:

folding the side portions in a direction towards the film;

inserting the object in the packaging structure through an opening defined by the unsecured edge portion of the film and the rigid panel;

folding the side portions in a direction opposite to that of said first folding step until the side portions are adjacent the surface of the panel opposite the film; and folding the end portions in a direction towards the film to secure the side portions in the folded position.

28. A method for packaging an object according to claim 27 further comprising the step of:

placing the folded panel into a box having interior dimensions corresponding to the peripheral dimensions of the folded panel.

29. A packaged structure wherein an object is securely held against a rigid backing, said packaged structure comprising:

a substantially rigid panel with a first pair of generally parallel fold lines adjacent opposite side edges of said panel that define respective folding side portions;

a second pair of fold lines in said rigid panel substantially parallel to one another and substantially perpendicular to said first pair of fold lines that define respective folding end portions in said rigid panel;

a packaged object having predetermined peripheral dimensions and positioned against a center panel portion of said rigid panel defined by said first and second pairs of fold lines, said center panel portion defining at least one opening therein having peripheral dimensions smaller than the peripheral dimensions of said packaged object such that said object cannot be moved through said opening;

a flexible film material superimposed on one surface of said rigid panel and extending over said center panel portion and past said first pair of fold lines onto said folding side portions of said rigid panel; and means for securing said film to said folding side portions of said rigid panel while defining at least one unsecured edge portion of said film adjacent to one of said second fold lines through which unsecured edge portion said object is inserted between said film and said center panel portion and for cooperating with said folding side portions to tighten said film against objects between said film and said center panel portion when said folding side portions are folded away from said film.

30. A packaged structure according to claim 29 wherein said center panel portion includes a patterned cut that defines a tab extending towards said film for separating more than one object packaged thereon.

31. A packaged structure according to claim 29 further comprising at least one opening formed in said substantially rigid panel along at least one of said fold lines.

32. A packaging structure for holding an object securely against a rigid backing, said packaging structure comprising:

a substantially rigid panel with a pair of generally parallel fold lines adjacent opposite side edges of said panel that define respective folding side flaps adapted to be folded in the same direction and a center panel portion therebetween;

a flexible film material superimposed on one surface of said rigid panel and extending over said center panel portion and past said fold lines onto said folding side flaps of said rigid panel; and means for securing said film to said folding side flaps of said rigid panel while defining at least one unsecured edge portion of said film and for cooperating with said folding side flaps to tighten said film against objects between said film and said center panel portion when said folding side flaps are folded away from said film, said securing means being spaced from said fold lines and providing an enlarged opening between said unsecured edge portion of said film and said center panel portion when said side flaps are folded in a direction towards said film to allow the object to be inserted between said film and said center panel portion.

33. A packaging structure according to claim 32 wherein each said securing means comprises a glue strip extending along the respective folding side flap of said rigid panel.

34. A packaging structure according to claim 33 wherein each of said glue strips comprises a plurality of glue strip segments having unsecured portions of film therebetween.

* * * * *